US012385355B1

(12) United States Patent
Gonzalez

(10) Patent No.: US 12,385,355 B1
(45) Date of Patent: Aug. 12, 2025

(54) DEEP SET WIRELINE RETRIEVABLE SAFETY VALVE

(71) Applicant: Halliburton Energy Services, Inc., Houston, TX (US)

(72) Inventor: Merced Gonzalez, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/610,964

(22) Filed: Mar. 20, 2024

(51) Int. Cl.
*E21B 34/10* (2006.01)

(52) U.S. Cl.
CPC ..... *E21B 34/106* (2013.01); *E21B 34/101* (2013.01); *E21B 2200/05* (2020.05)

(58) Field of Classification Search
CPC ..... E21B 34/10; E21B 34/101; E21B 34/102; E21B 34/106
See application file for complete search history.

(56) References Cited

U.S. PATENT DOCUMENTS 3,763,932 A * 10/1973 Dinning ..... E21B 34/106 166/322
3,763,933 A * 10/1973 Mott ..... E21B 34/106 166/322
4,273,186 A * 6/1981 Pearce ..... E21B 34/106 166/324
4,440,221 A 4/1984 Taylor et al.
4,577,694 A * 3/1986 Brakhage, Jr. ..... E21B 34/12 166/382
4,605,070 A * 8/1986 Morris ..... E21B 34/106 166/380
4,621,695 A * 11/1986 Pringle ..... E21B 34/10 251/63.4

(Continued)

FOREIGN PATENT DOCUMENTS

EP 1138873 B1 3/2005
GB 2378970 A * 2/2003 ..... E21B 34/10

(Continued)

OTHER PUBLICATIONS

Foreign Communication from Related Application—International Search Report and Written Opinion of the International Searching Authority, International Application No. PCT/US2024/022952, dated Dec. 17, 2024, 12 pages.

(Continued)

*Primary Examiner* — Jennifer H Gay
(74) *Attorney, Agent, or Firm* — Conley Rose, P.C.; Rodney B. Carroll

(57) ABSTRACT

Disclosed embodiments relate to hydraulic safety valves for a well, which may be configured to close in the event of a loss of pressure for example. In embodiments, the safety valve may comprise a wireline retrievable safety valve (WRSV) configured for use within a tubing retrievable safety valve (TRSV) in a wellbore, for example to provide safety valve functionality in the event that the TRSV no longer functions properly. The WRSV may be configured to be operated using the hydraulic lines(s) of the TRSV, for example a control line and a balance line. In embodiments, a control piston of the WRSV may be in fluid communication with the control line through the TRSV, and a balance piston of the WRSV may be in fluid communication with the balance line through the TRSV. Related methods and systems are also disclosed.

23 Claims, 13 Drawing Sheets

(56) References Cited

U.S. PATENT DOCUMENTS

| | | | | |
|---|---|---|---|---|
| 5,496,044 | A | 3/1996 | Beall et al. | |
| 6,003,605 | A | 12/1999 | Dickson et al. | |
| 6,352,118 | B1 * | 3/2002 | Dickson | E21B 29/08 166/322 |
| 7,032,672 | B2 * | 4/2006 | Dennistoun | E21B 34/10 166/321 |
| 7,392,849 | B2 * | 7/2008 | Lauderdale | E21B 34/10 166/324 |
| 7,552,774 | B2 * | 6/2009 | Anderson | E21B 34/101 166/321 |
| 7,694,742 | B2 * | 4/2010 | Bane | E21B 23/065 166/374 |
| 8,251,147 | B2 * | 8/2012 | Mondelli | E21B 34/107 166/266 |
| 9,206,670 | B2 | 12/2015 | Webber et al. | |
| 9,383,029 | B2 * | 7/2016 | Scott | E21B 34/101 |
| 9,523,260 | B2 * | 12/2016 | Mailand | E21B 34/102 |
| 9,739,116 | B2 * | 8/2017 | Kirkpatrick | E21B 34/106 |
| 9,982,510 | B2 | 5/2018 | Vick, Jr. et al. | |
| 10,030,475 | B2 * | 7/2018 | Vick, Jr. | E21B 34/14 |
| 10,113,392 | B2 | 10/2018 | Vick, Jr. et al. | |
| 10,513,908 | B2 * | 12/2019 | Scott | E21B 34/106 |
| 10,655,431 | B2 * | 5/2020 | Gonzalez | E21B 34/063 |
| 10,920,529 | B2 | 2/2021 | Mailand et al. | |
| 10,989,020 | B2 | 4/2021 | Vick, Jr. | |
| 11,015,418 | B2 * | 5/2021 | Burris | E21B 34/10 |
| 11,131,161 | B2 | 9/2021 | Fripp et al. | |
| 11,180,974 | B2 | 11/2021 | Vick, Jr. et al. | |
| 11,661,826 | B2 | 5/2023 | Dusterhoft et al. | |
| 2002/0074129 | A1 * | 6/2002 | Moore | E21B 34/10 166/324 |
| 2005/0056430 | A1 * | 3/2005 | Dennistoun | E21B 34/106 166/321 |
| 2006/0196669 | A1 * | 9/2006 | Lauderdale | E21B 34/10 166/321 |
| 2008/0066921 | A1 * | 3/2008 | Bane | E21B 34/10 166/332.8 |
| 2008/0128137 | A1 * | 6/2008 | Anderson | E21B 34/101 166/321 |
| 2009/0090501 | A1 | 4/2009 | Hansen et al. | |
| 2009/0277643 | A1 * | 11/2009 | Mondelli | E21B 34/107 166/319 |
| 2011/0094752 | A1 | 4/2011 | Hudson et al. | |
| 2013/0032355 | A1 | 2/2013 | Scott et al. | |
| 2014/0000870 | A1 | 1/2014 | Vick, Jr. et al. | |
| 2015/0316170 | A1 * | 11/2015 | Scott | F16K 31/1225 251/324 |
| 2015/0354316 | A1 * | 12/2015 | Kirkpatrick | E21B 34/106 166/375 |
| 2015/0361763 | A1 * | 12/2015 | Mailand | E21B 34/10 166/321 |
| 2015/0369005 | A1 * | 12/2015 | Vick, Jr. | E21B 34/10 166/243 |
| 2016/0258250 | A1 | 9/2016 | Mck, Jr. et al. | |
| 2017/0067315 | A1 | 3/2017 | Mailand et al. | |
| 2018/0202261 | A1 * | 7/2018 | Scott | E21B 34/16 |
| 2018/0328145 | A1 * | 11/2018 | Gonzalez | E21B 34/063 |
| 2019/0353008 | A1 | 11/2019 | Lake | |
| 2019/0376366 | A1 * | 12/2019 | Burris | E21B 34/063 |
| 2020/0063518 | A1 | 2/2020 | Fripp et al. | |
| 2020/0240236 | A1 | 7/2020 | Cress et al. | |
| 2020/0308932 | A1 | 10/2020 | Vick, Jr. | |
| 2023/0037547 | A1 | 2/2023 | Newton | |
| 2024/0125205 | A1 * | 4/2024 | Gonzalez | E21B 34/14 |
| 2024/0337170 | A1 | 10/2024 | Gassen et al. | |

FOREIGN PATENT DOCUMENTS

| | | | | |
|---|---|---|---|---|
| NO | 781238 | L * | 10/1978 | |
| WO | 2018227003 | A1 | 12/2018 | |
| WO | WO-2022154944 | A1 * | 7/2022 | E21B 34/08 |

OTHER PUBLICATIONS

Foreign Communication from Related Application—International Search Report and Written Opinion of the International Searching Authority, International Application No. PCT/US2023/086481, dated Apr. 26, 2024, 8 pages.

Office Action dated Sep. 20, 2024 (9 pages), U.S. Appl. No. 18/535,644, filed Dec. 11, 2023.

Schlumberger, "GeoGuard high-performance deepwater safety valves", 2021, 1 page.

* cited by examiner

DEEP SET WIRELINE RETRIEVABLE SAFETY VALVE

CROSS-REFERENCE TO RELATED APPLICATIONS

Not applicable.

STATEMENT REGARDING FEDERALLY SPONSORED RESEARCH OR DEVELOPMENT

Not applicable.

FIELD

This disclosure relates generally to safety valves. More particularly, this disclosure relates to wireline retrievable safety valves for use in downhole operations, such as hydrocarbon production, as a secondary safety valve, for example in response to a faulty tubing retrievable safety valve.

BACKGROUND

Well safety valves may be installed in a wellbore to prevent uncontrolled release of reservoir fluids. For example, safety valves may be configured to close if there is a failure or other emergency situation in the system that could lead to uncontrolled release of reservoir fluids. In embodiments, a subsurface safety valve may be biased to a closed position, so that it is configured to close the valve in the event that operator control is lost. A safety valve should ideally close as quickly and/or reliably as possible during a process upset or in the event of an emergency, to ensure operational and/or environmental safety. While there are different types of safety valves, hydraulic safety valves may be configured to automatically close in the event of loss of pressure. For example, hydraulic safety valves may be opened by application of hydraulic pressure to a piston, which can actuate the valve to position it in an open position. The hydraulic control pressure holds the valve in the open position. If control pressure is lost, the valve would then close.

One type of hydraulic safety valve is a tubing retrievable safety valve. A tubing retrievable safety valve (TRSV) may be adapted to be positioned in a well tubing string (e.g. a tubular string, such as production tubing), to control the flow through the tubing string. As TRSVs are often subjected to years of service in severe operating conditions, failure of the TRSV is possible. For example, a TRSV in the closed position may eventually form leak paths. Alternatively, a TRSV in the closed position may not properly open when actuated. Because of the potential for operational problems in the absence of a properly functioning TRSV (and especially since TRSVs often function as failsafe valves, having important safety implications), mitigation measure must be taken promptly when there is a TRSV failure. Since TRSVs are incorporated into the production tubing, however, repairing or replacing a malfunctioning TRSV would require removal of the entire production tubing, which can be expensive and/or time-consuming. Thus, there is a need for an effective way to mitigate TRSV failure, for example so that safety valve operation can be restored without having to remove the production tubing from the well. This can be particularly challenging in deep set applications, for example due to issues arising from hydrostatic pressure.

BRIEF DESCRIPTION OF THE DRAWINGS

For a more complete understanding of the present disclosure, reference is now made to the following brief description, taken in connection with the accompanying drawings and detailed description, wherein like reference numerals represent like parts. These drawings illustrate certain aspects of some examples of the present disclosure and should not be used to limit or define the disclosure.

FIG. 5AA is an enlarged portion of FIG. 5A for convenient reference, according to an embodiment of the disclosure;

FIG. 5BB is an enlarged portion of FIG. 5B for convenient reference, according to an embodiment of the disclosure;

FIG. 5CC is an enlarged portion of FIG. 5C for convenient reference, according to an embodiment of the disclosure;

FIG. 5DD is an enlarged portion of FIG. 5D for convenient reference, according to an embodiment of the disclosure;

DETAILED DESCRIPTION

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid. "Upstream" is directed counter to the direction of flow of fluid, while "downstream" is directed in the direction of flow of fluid, as persons of skill will understand.

Figure 1:
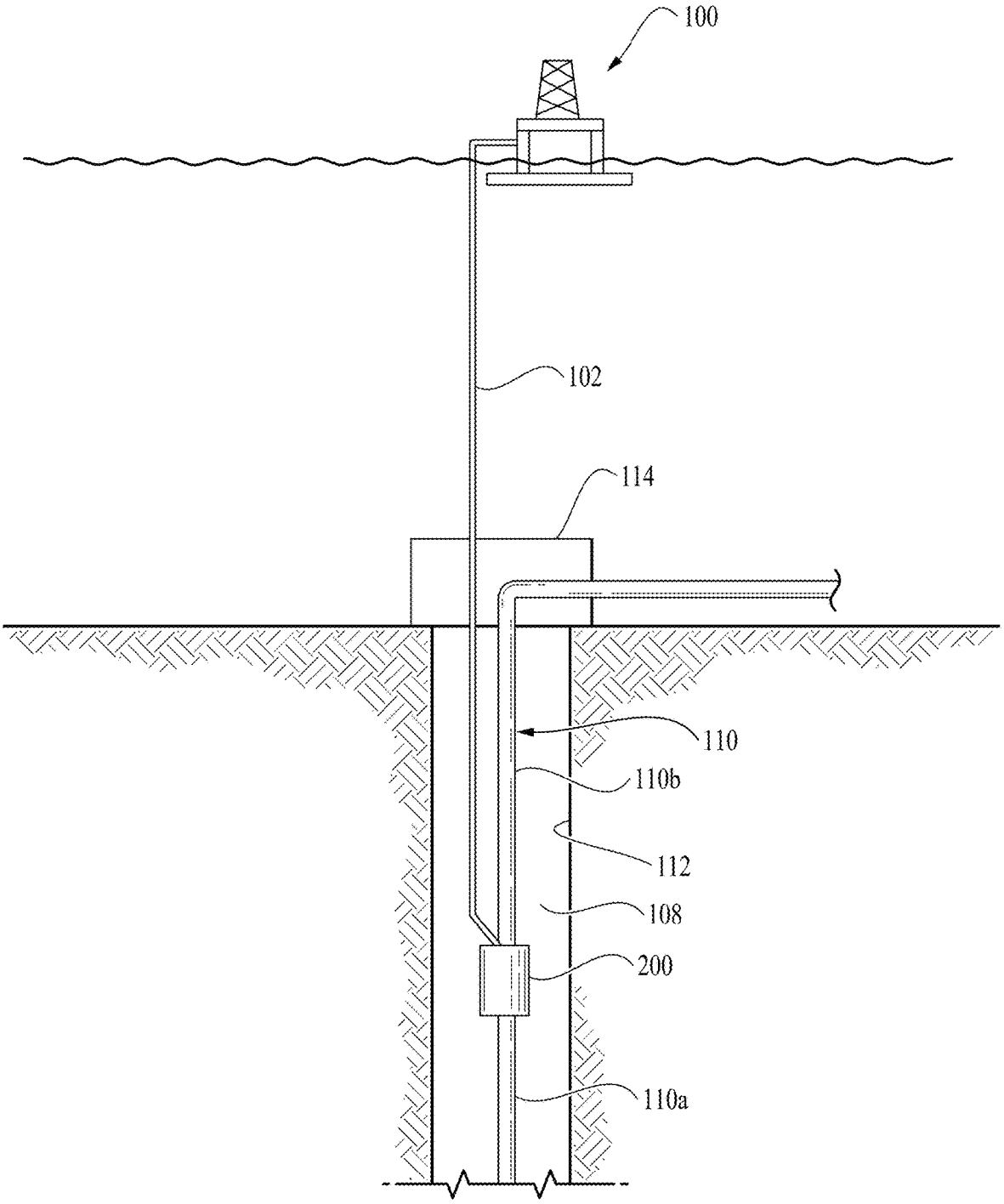
FIG. 1 is a diagram of an exemplary offshore well having an illustrative safety valve, according to an embodiment of the disclosure.

FIG. 1 illustrates an exemplary offshore platform 100 connected to a hydraulically controlled safety valve 200 disposed in a well 112 via one or more hydraulic connection 102. An annulus 108 may be defined between walls of well 112 and a conduit 110. Wellhead 114 may provide a means to hand off and seal conduit 110 against well 112 and/or provide a profile to latch a subsea blowout preventer to. Conduit 110 may be coupled to wellhead 114. While conduit 110 may generally be any conduit such as a casing, liner, production tubing, or other tubulars disposed in a wellbore, in embodiments conduit 110 comprises production tubing. It is to be understood that the various examples of the present safety valve 200, tubular string, and related systems described herein may be utilized in various orientations, such as inclined, inverted, horizontal, vertical, etc., and in various configurations, without departing from the principles of the present disclosure. Although safety valve 200 is illustrated as being disposed within an offshore well, one of ordinary skill in the art will appreciate that safety valve 200 may be disposed in any type of wellbore, including onshore and offshore type wellbores, without deviating from the present disclosure. Furthermore, while hydraulic connection 102 is illustrated as being connected to an offshore platform, hydraulic connection 102 may be connected to any type of completion or other element without departing from the disclosure.

Safety valve 200 may be interconnected in conduit 110 and positioned in well 112. Safety valve 200 may provide a means to isolate a lower portion of conduit 110 from an upper portion of conduit 110, for example providing control of fluids through the conduit 110. The lower portion of conduit 110 (which is labeled 110*a* in FIG. 1) may be fluidically connected to a subterranean formation such that formation fluids may flow into the lower portion of conduit 110. In some embodiments, one or more packers may be placed between the lower portion of the conduit 110*a* and the casing or wall of the wellbore, so that fluid from the formation which enters the wellbore flows into the conduit 110 and then uphole (e.g. to the surface) through its bore. Hydraulic connection 102 may extend into the well 112 and may be connected to safety valve 200. In some embodiments, hydraulic connection 102 may comprise a plurality of hydraulic lines, such as a control line and a balance line (as discussed below). Hydraulic connection 102 may provide pressure to actuate (e.g. open) safety valve 200, for example as discussed in more detail below. As will be described in further detail below, pressure may be used to actuate the safety valve 200, for example driving components of the safety valve to an open position and/or holding the components in place in the open position. Actuation may include opening safety valve 200 to provide a flow path for wellbore fluids in a lower portion 110*a* of conduit 110 to flow into an upper portion 110*b* of conduit 110. Hydraulic connection 102 may also provide a means to close safety valve 200 and isolate a lower portion 110*a* of conduit 110 to flow from an upper portion 110*b* of conduit 110 to provide well control. For example, loss of pressure in hydraulic connection 102 may serve to close the safety valve 200.

Figure 2A:
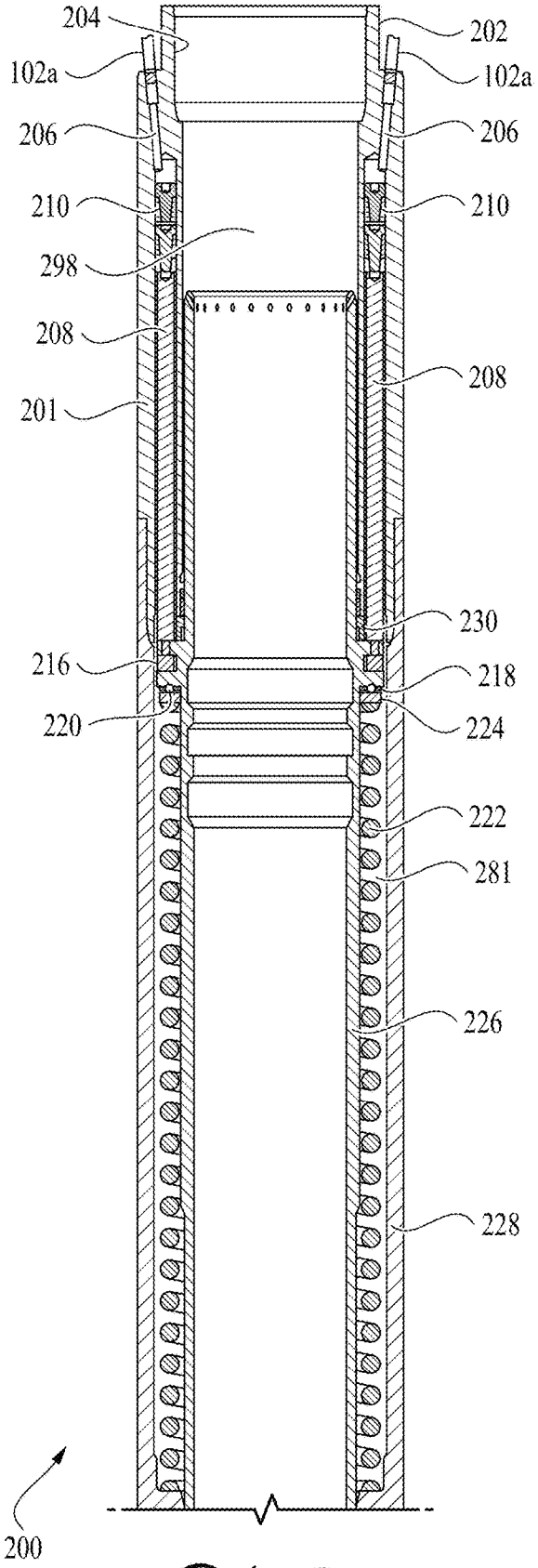
FIGS. 2A-B jointly illustrate an exemplary TRSV in a closed configuration, according to an embodiment of the disclosure.
Figure 4:
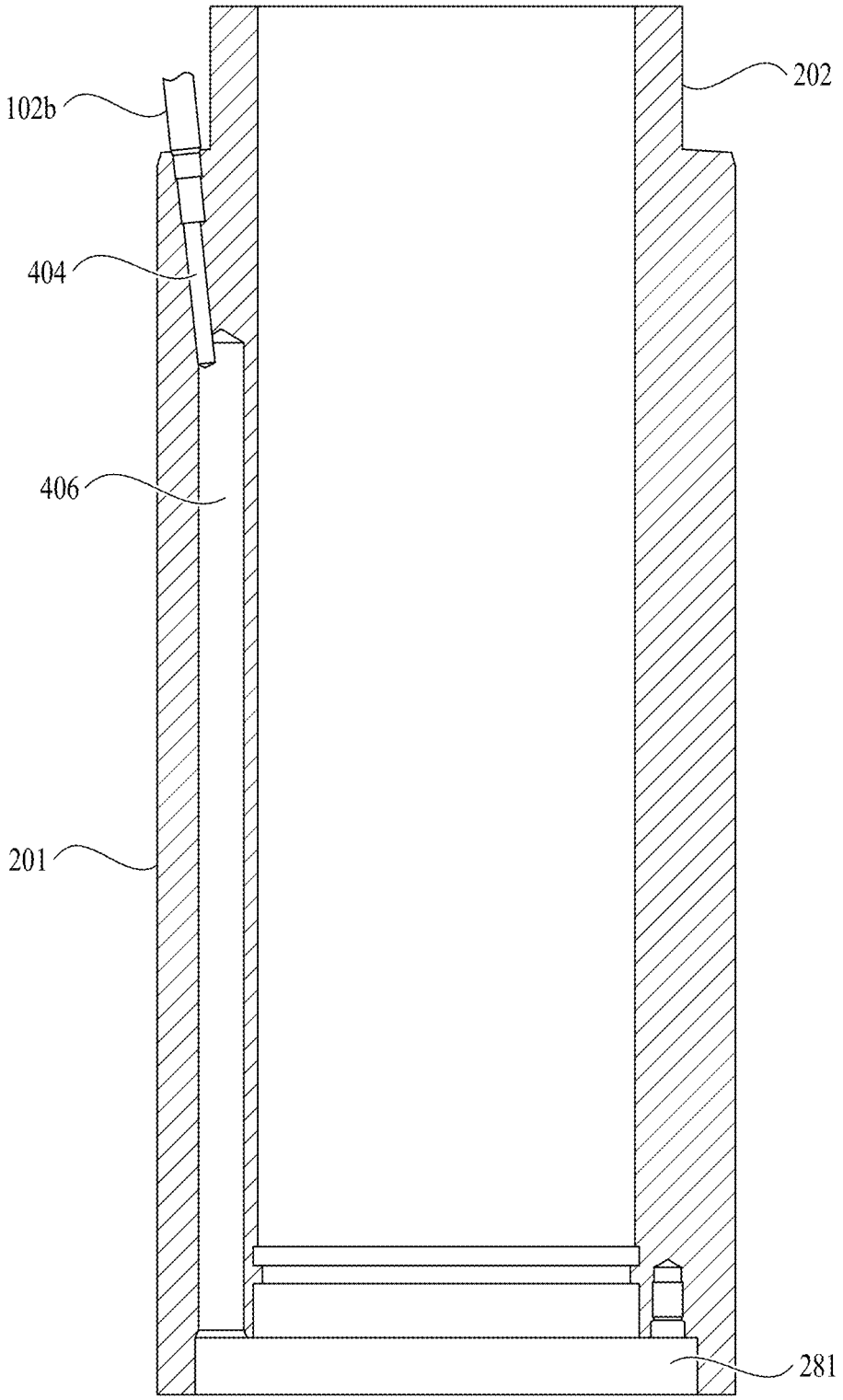
FIG. 4 illustrates a portion of the TRSV of FIGS. 2A-3B.

In order to operate the subsurface safety valve 200 from the surface, a control line and balance line may be used (e.g. the hydraulic connection 102 may comprise the control line 102*a* and the balance line 102*b*, see for example FIGS. 2A and 4). In order to open the subsurface safety valve 200, hydraulic pressure can be applied via the control line. In accordance with the present invention, the balance line can supply a balancing pressure to compensate for the effects of hydrostatic pressure on the control line. Control of the hydraulic pressure applied via the control line and balance line may be effectuated through, for example a control manifold, which may be located on the surface.

Figure 3A:
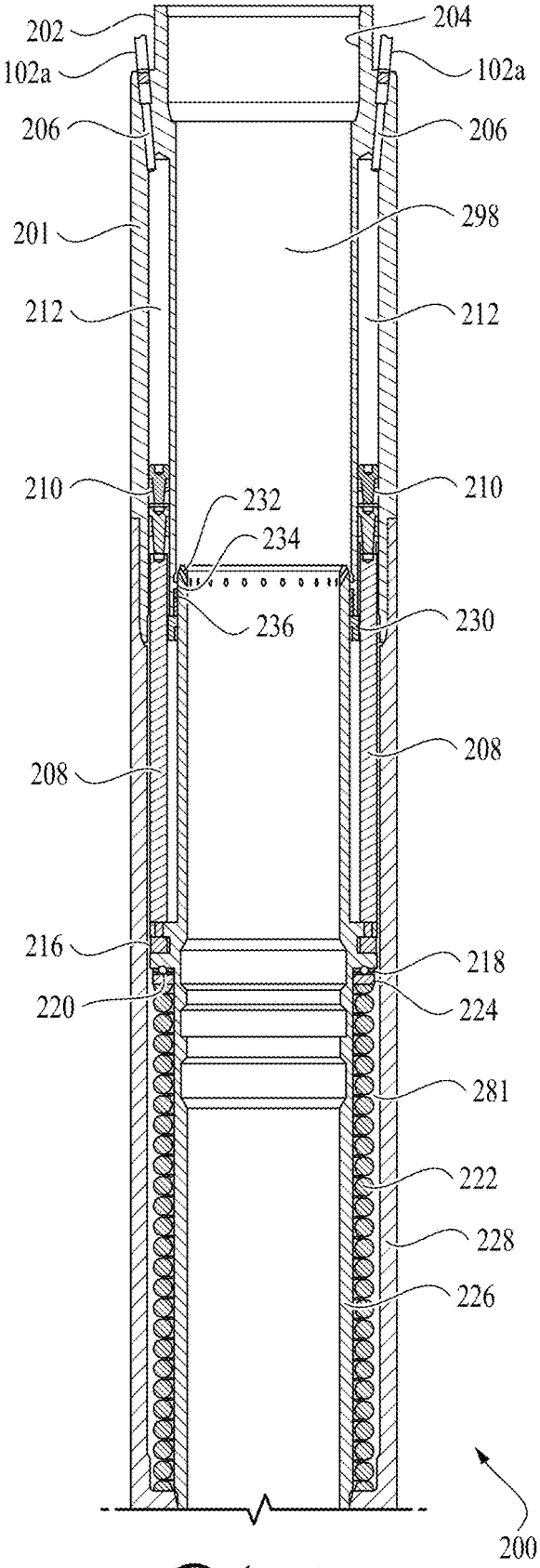
FIGS. 3A-B jointly illustrate the TRSV of FIGS. 2A-B in an open configuration.
Figure 2B:
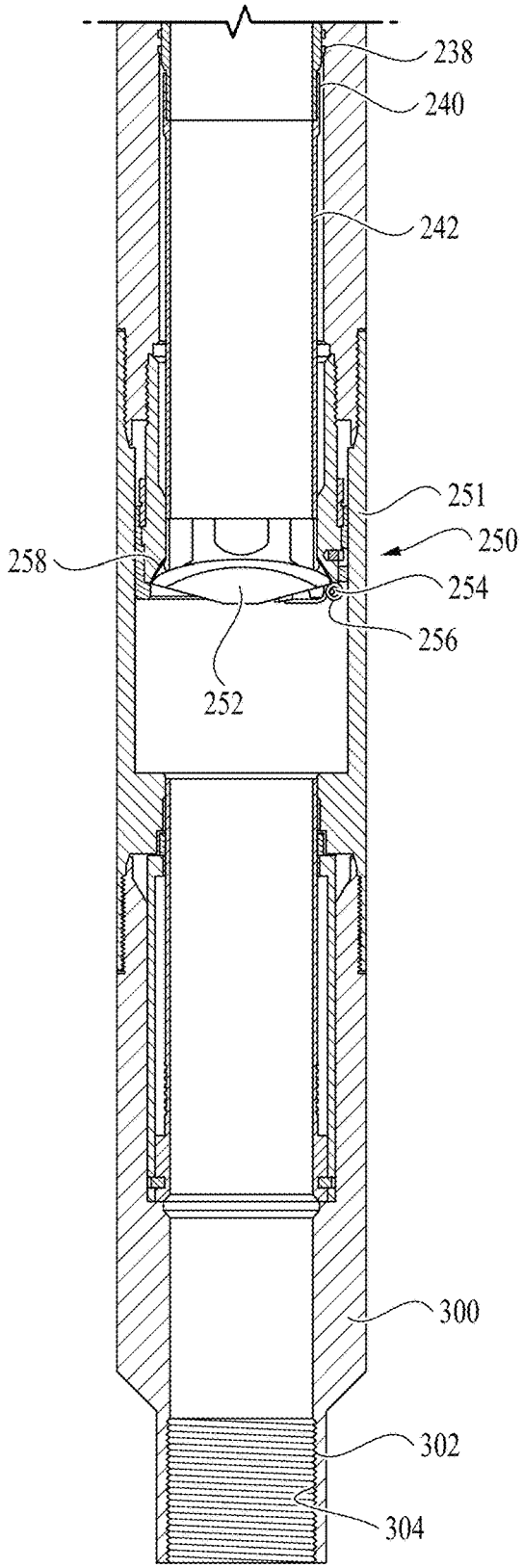
Figure 3B:
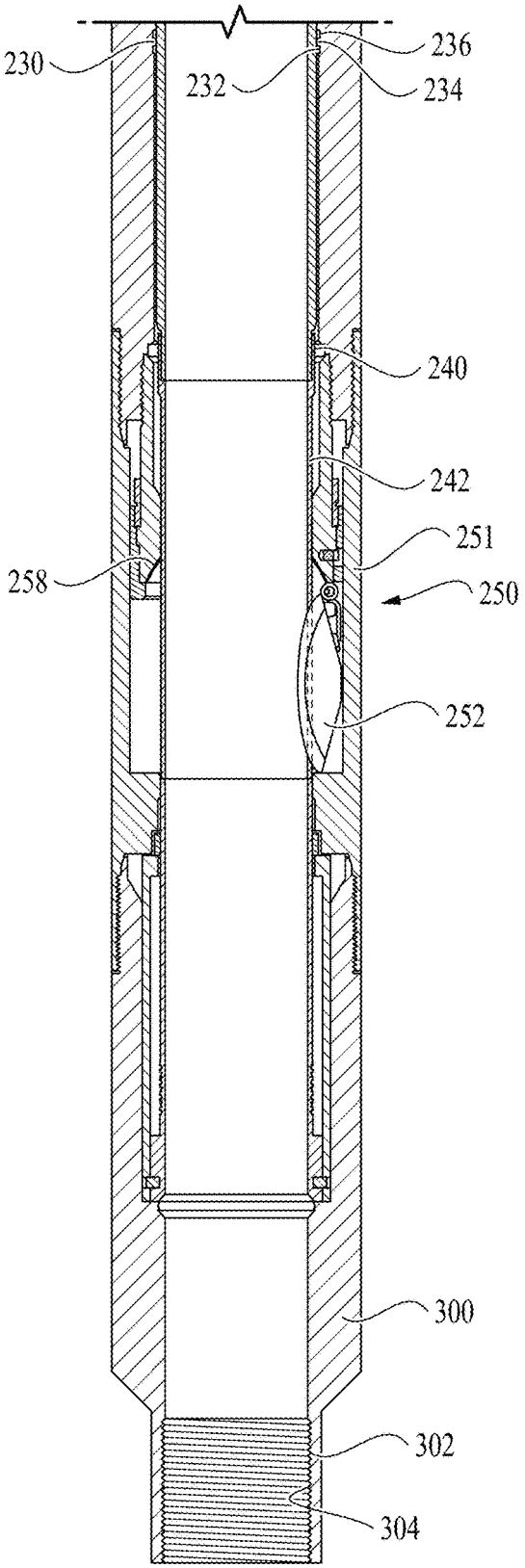

In some embodiments, the safety valve 200 may comprise a tubing retrievable safety valve (TRSV). For example, the TRSV 200 may be fluidly coupled in the conduit 110 (e.g. as part of the tubular string). FIGS. 2A-B and 3A-B, illustrate the structure and operation of an exemplary TRSV 200. FIGS. 2A-B and 3A-B are essentially identical, except that FIGS. 2A-B depict the TRSV 200 in a closed position, whereas FIGS. 3A-B illustrate the TRSV 200 in the open position. In FIGS. 2A-3B, the tubing retrievable safety valve 200 includes a top sub or annular body 201 comprising an annular housing defining a fluid passageway/longitudinal bore 298, with a neck portion 202. The neck portion 202 may include a connection/engagement mechanism for coupling the body 201 to the tubular string/conduit 110, for example including threaded portion 204 for engaging the tubing string. The tubing replaceable safety valve 200 of FIGS. 2A-B also includes a similarly configured bottom sub or annular body 300 including neck portion 302 with threaded portion 304 for engaging the tubing string. While FIGS. 2A-3B illustrate the TRSV 200 body as being formed of multiple body elements, in other embodiments the TRSV body may be integral (e.g. the annular bodies 201 and 300 may be portions of a unitary body). One or more control tubes or lines 102*a* are connected to control conduits 206 for transmitting hydraulic control pressure to cylinder or piston rod bore 212.

In some embodiments, two control conduits 206 disposed radially at 180 degrees relative to each other, may extend through top sub 200. In some embodiments, a third or balance conduit 404 may be configured for fluid communication with balance line 102*b*, and may be positioned in a different plane from the control line(s) 102*a*, for example positioned radially at 90 degrees from the control line 102*a* for transmission of balance pressure. Although the illustrated embodiment shows two control conduits and one balance conduit, it will be appreciated by those skilled in the art that the number of conduits as well as the number of balance and control lines utilized in the practice of the present invention may be varied depending upon the specific application.

In FIGS. 2A-B, a piston rod 208 is moveably positioned in piston rod bore 212 for reciprocal movement in a longitudinal/axial direction relative to the tubing string. Piston rod seal assembly 210 can isolate piston rod 208 from piston rod bore 212. In accordance with the present invention, hydraulic pressure applied via a control tube or line 102*a* is communicated via a control conduit 206 to a piston rod bore 212 to reciprocate piston rod 208 (which can also be termed a TRSV operating piston) in an axial direction (e.g. downhole and/or towards the valve).

In embodiments, the rod piston seal assembly 210 includes upper and lower concentric non-elastomer seal members urged into sealing engagement with annular wall of piston rod bore 212, for example by energizing springs. Dynamic seals may also be provided. Dynamic seal can include an O-ring interposed between retainers.

Referring again to FIGS. 2A-B and 3A-B, upon actuation by the application of control pressure (e.g. via control line 102*a*), piston rod 208, in turn, engages concentric bearing assembly 218 (which can include bearings 216 and bearing retainer 220) to transmit compressive force to spring 222. In embodiments, the use of concentric bearing assembly may reduce any torsional effects resulting from the use of helical spring 222 to bias the valve and thus, in turn, reduces wear on other parts of the valve assembly. Spring 222 is positioned in sealed spring chamber 281 between spring housing 228 and spring guide 226 to control movement of the spring in a longitudinal/axial direction relative to the axis of the tubing string. A concentric spring compression ring 224 can be interposed between bearing assembly 218 and spring 222 to provide uniform transmission of force from the piston rod 208 to the spring 222.

In FIGS. 2A-B, spring 222 is positioned in chamber 281 between spring house 228 and spring guide 226 for compression in a longitudinal axis direction relative to the tubing string. A dynamic seal assembly 230 can be provided to ensure an adequate seal between the piston rod bore 212 and spring housing 228 to isolate the spring chamber 281 from well pressure.

Dynamic seal assembly 230 may, as illustrated, include a lip seal 232, a back up or retaining ring 234 and an O-ring 236. The sealing assembly may provide isolation between well fluids and the safety valve assembly as piston rod 208 reciprocates in a longitudinal direction relative to the tubing string. As illustrated, the same sealing mechanism can be used to isolate the spring housing 228 adjacent the bottom of spring chamber 281, including a lip seal 232, a back up or retaining ring 234 and an O-ring 236. Additionally, piston rod guide 238 may control movement of piston rod 208 in a lateral direction relative to the longitudinal axis of the tubing string.

As best illustrated in FIGS. 3A-B, upon compression of spring 222, spring housing 228 may be displaced downwardly. Shoulder 240 can engage longitudinally extending operator 242, displacing the operator in a downward axial direction. Operator 242 in turn can engage valve assembly 250 to place the valve in an open position. As illustrated, valve assembly 250 comprises a flapper-type valve enclosed in valve housing 251. It is, however, contemplated that other valve types, such as a ball valve may be advantageously utilized in the practice of the present invention. Similarly, as illustrated longitudinally extending operator 242 is a tubular member (e.g. an axially slidable sleeve) extending axially relative to the tubing string, however it is contemplated that other geometries may be utilized in exemplary TRSV 200 embodiments.

As noted above, upon compression of spring 222 (e.g. due to applied pressure through the control line 102*a*), operator/sleeve 242 can be displaced in an axial direction, thereby engaging flapper valve assembly 250. In embodiments, flapper valve assembly 250 can include closure member or flapper 252 pivotally mounted on flapper pin 254 and tension spring 256. In the closed position, the flapper 252 may seal against valve seat 258. Tension spring 256 can bias flapper 252 to the closed position to aid in sealing to flapper 252 against valve seat 258. In the illustrated embodiment, the flapper 252 is oval, however other geometries may be applicable.

The spring 222 may be configured to bias the operator/sleeve 242 uphole and/or away from the valve 252 (e.g. towards the closed position). So in operation, sufficient pressure applied through control line 102*a* may be transmitted through the piston rod 208 to open the valve, for example compressing spring 222 and extending operator/sleeve 242 through the valve assembly 250. The valve assembly 250 may be held open so long as sufficient pressure is applied via control line 102*a*, with the spring 222 biasing the operator/sleeve 242 towards the closed position. Upon loss of pressure in the control line 102*a*, the valve assembly 250 closes. For example, the biased operator/sleeve 242 (no longer opposed by pressure on the piston rod 208) can move uphole towards its closed position, resulting in the valve assembly 250 closing.

As should be appreciated by those skilled in the art, the depth at which a spring biased subsurface safety valve can be operated is limited due to the hydrostatic pressure generated by the column of fluid in the control line 102*a*. Since the hydrostatic force applied by the column of fluid in the control line 102*a* varies with the depth at which the valve 200 is positioned, the constant counteracting spring force biasing the safety valve can be overcome by the hydrostatic head in some instances, rendering the valve inoperative at greater than design depths and/or requiring very large spring forces to effectively close the valve. For example, a deep set TRSV 200 may have mechanical limitations due to force available from a spring versus the hydrostatic loads the rod piston seals may see during a failure. In most cases deep water drilling requires the safety valve be set deeper than the mechanical spring force may allow. Using a balance line 102*b* in addition to a control line 102*a* can overcome this limitation.

Referring again to FIGS. 2A-B and 3A-B, in accordance with the present invention, the subsurface safety valve 200 can be isolated from well pressure by dynamic seal assemblies 230. In order to enable the subsurface safety valve to operate at depths where the biasing force provided by spring 222 would be overcome by the hydrostatic force of the fluid in control line 102*a*, it is necessary to balance the hydrostatic forces. In order to counteract the hydrostatic head of the control line 102*a*, balance line 102*b* can supply hydraulic pressure via balance conduit 404. In some embodiments, balance line 102*b* may supply balance pressure to spring chamber 281 and/or act on the downhole end of piston rod 208 (e.g. in opposition to the force generated on the uphole end of piston rod 208 by pressure from control line 102*a*). Thus, when subsurface safety valve 200 is positioned at a depth where the hydrostatic head in control line 102*a* is sufficient to overcome the biasing force of spring 222, a compensating force may be applied via balance line 102*b* through conduit 404 and passageway 406 to spring chamber 281 as best seen in FIG. 4. In other embodiments, the compensating force may be applied indirectly, for example with pressure from balance line 102*b* applied to a compensating (e.g. balance) piston which can be linked (e.g. for axial movement) with piston rod 208, but with applied force axially opposite that applied by the control line 102*a* to piston rod 208. For example, this may provide a tubing pressure insensitive, non-equalizing safety valve. In some embodiments, the TRSV 200 may be configured similar to DepthStar™ or Equistar™ safety valve products by Halliburton. The balancing force may allow the safety valve 200 to be positioned at various depths irrespective of the biasing force applied by spring 222. Thus, the TRSV 200 may be configured to be in fluid communication with both a control line and a balance line, and the TRSV 200 can provide a depth or well-insensitive subsurface safety valve capable of being operated over a wide range of depths, irrespective of the particular biasing spring design.

As TRSVs are often subjected to years of service in severe operating conditions, failure of TRSVs may occur. For example, a TRSV in the closed position may leak. Alternatively, a TRSV in the closed position may not properly open. Because of the potential for disaster in the absence of a properly functioning TRSV, it is vital that the malfunctioning TRSV be promptly replaced or repaired. As TRSVs are typically incorporated into the tubing string, replacing or repairing a malfunctioning TRSV typically may require removal of the tubing string from the wellbore. Depending on the circumstances, the cost of pulling the tubing string out of the wellbore can run into the millions of dollars.

It has been found, however, that a wireline retrievable safety valve ("WRSV") may be inserted inside the original TRSV (while the TRSV is in place in the production tubing downhole in the well) and operated to provide the same safety function as the original TRSV (e.g. which is no longer functioning properly and/or is no longer fully operational). These valves are designed to be lowered into place from the surface via wireline and locked in place inside the original TRSV. This method can provide a much more efficient and cost-effective alternative to pulling the tubing string when there is failure of the TRSV. In embodiments, the WRSV can take over the full functionality of the original TRSV by the WRSV being in fluid communication with the hydraulic control system of the TRSV (e.g. the control and balance lines). For example, the WRSV may be in fluid communication with the control line through the TRSV, and the WRSV may be in fluid communication with the balance line through the TRSV.

Figure 5A:
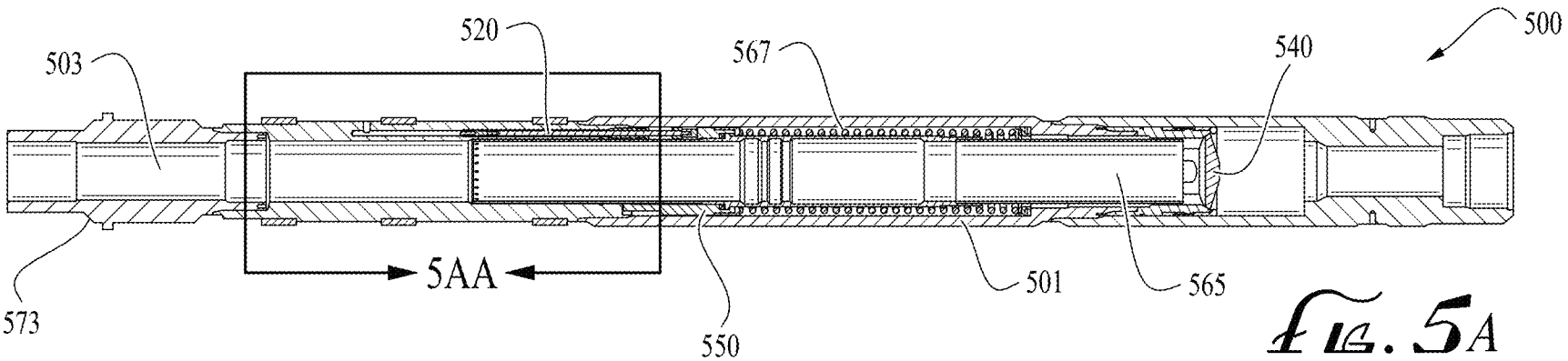
FIG. 5A is a cross-sectional view schematically illustrating a control port and operating piston of an exemplary wireline retrievable safety valve (WRSV) in a closed position, according to an embodiment of the disclosure.
Figure 5A:
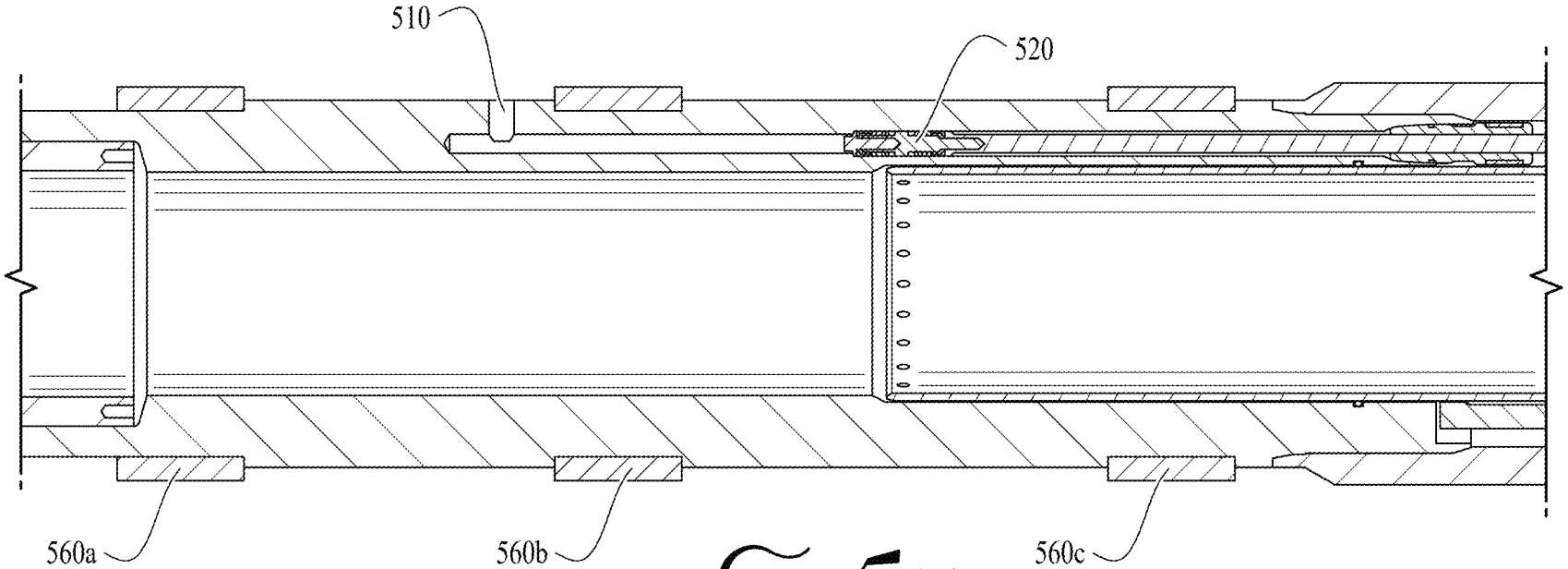
Figure 5B:
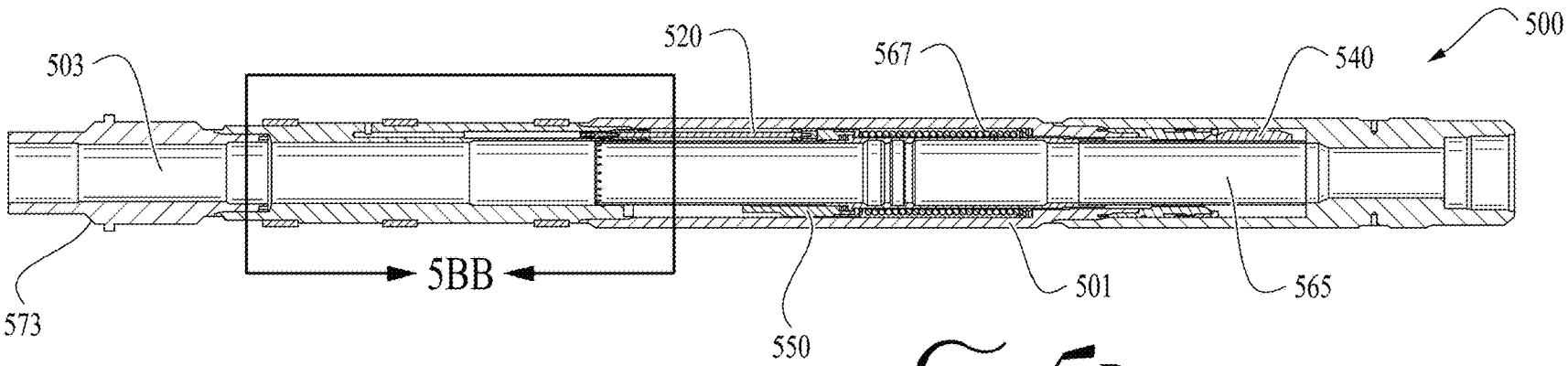
FIG. 5B is a cross-sectional view schematically illustrating the control port and operating piston of the WRSV of FIG. 5A in an open position.
Figure 5B:
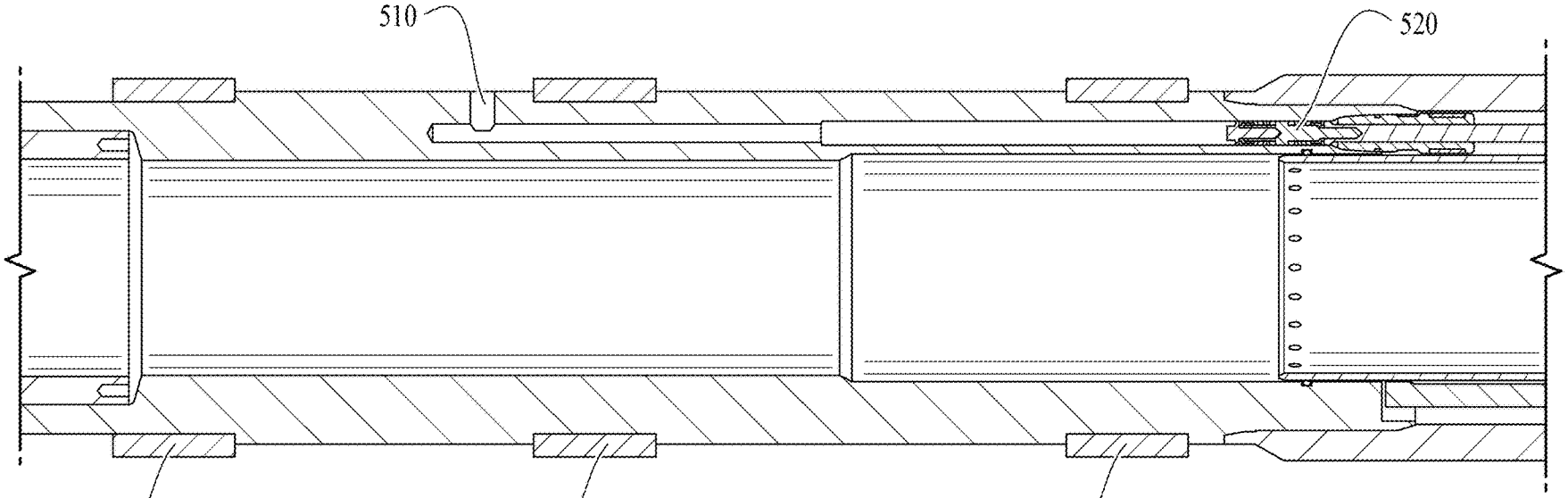
Figure 5C:
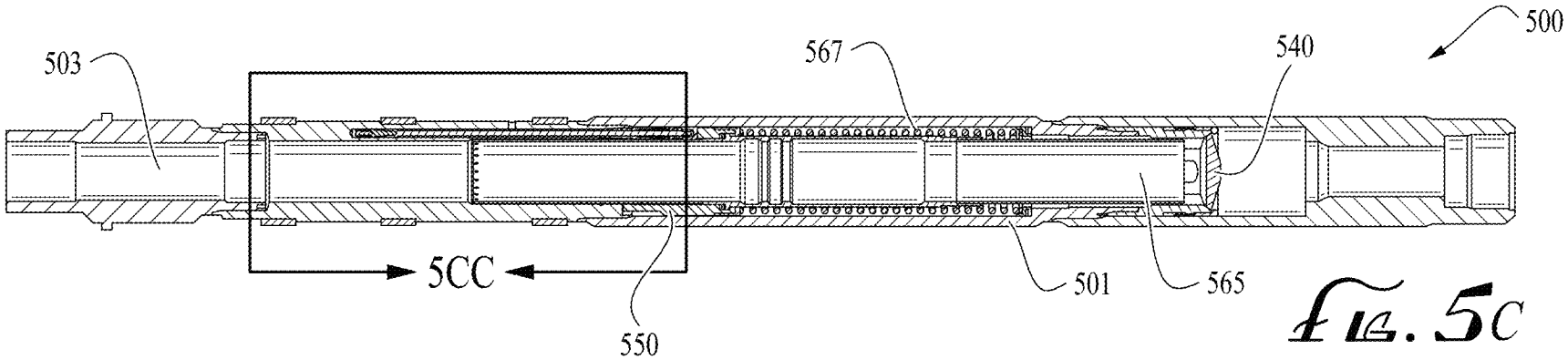
FIG. 5C is a cross-sectional view schematically illustrating a balance port and balance piston of the WRSV of FIG. 5A in a closed position, with the cross-sectional view of FIG. 5C rotationally offset from that of FIG. 5B.
Figure 5C:
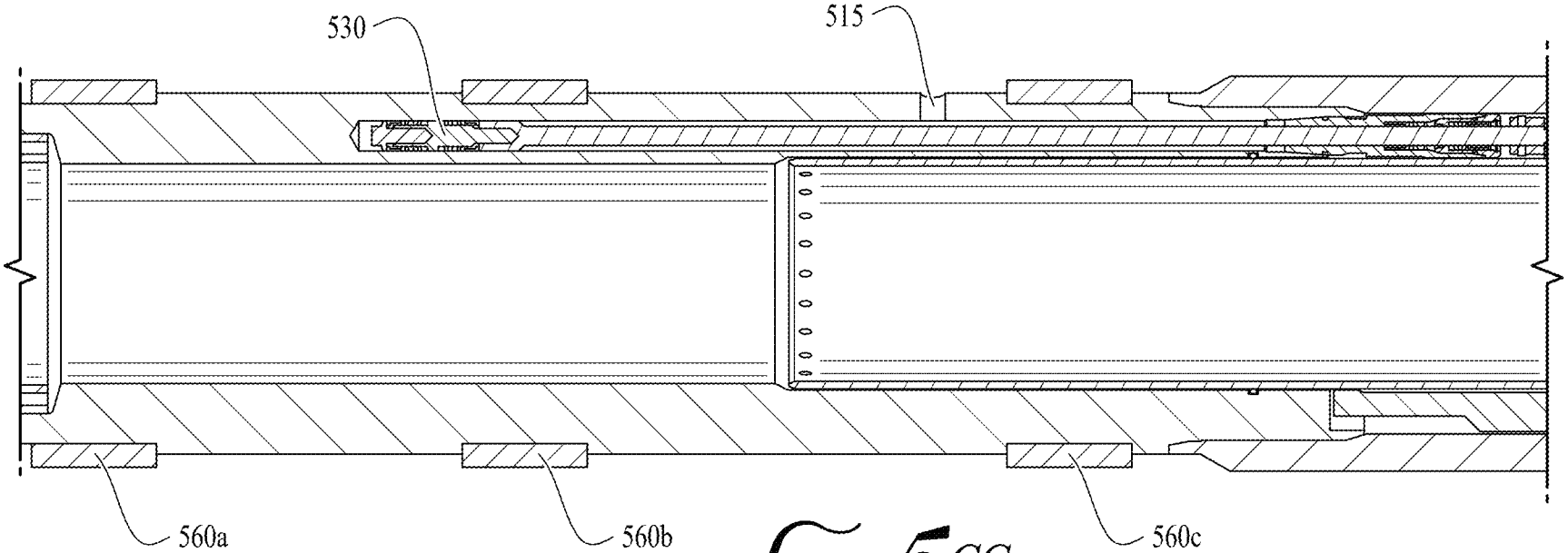
Figure 5D:
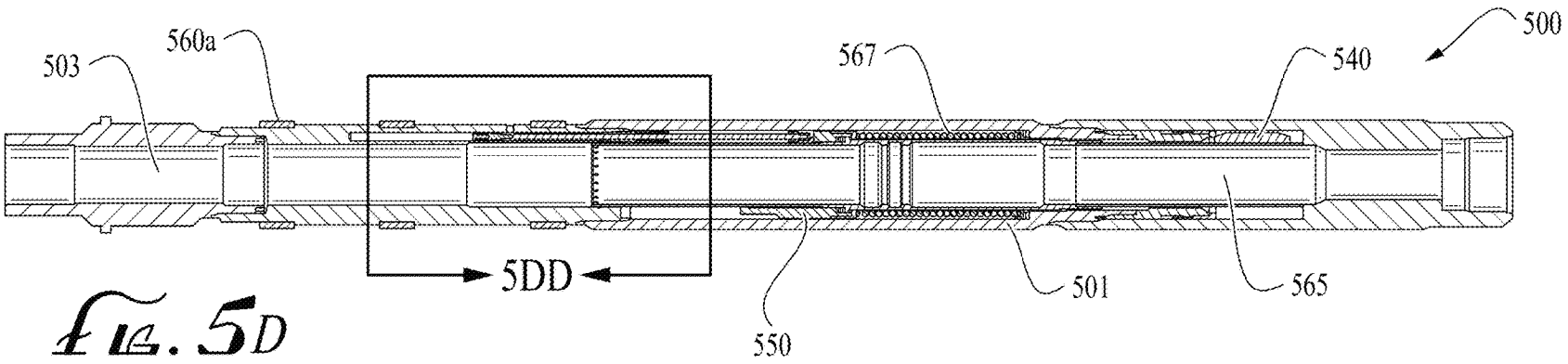
FIG. 5D is a cross-sectional view schematically illustrating the balance port and balance piston of the WRSV of FIG. 5A in an open position.
Figure 5D:
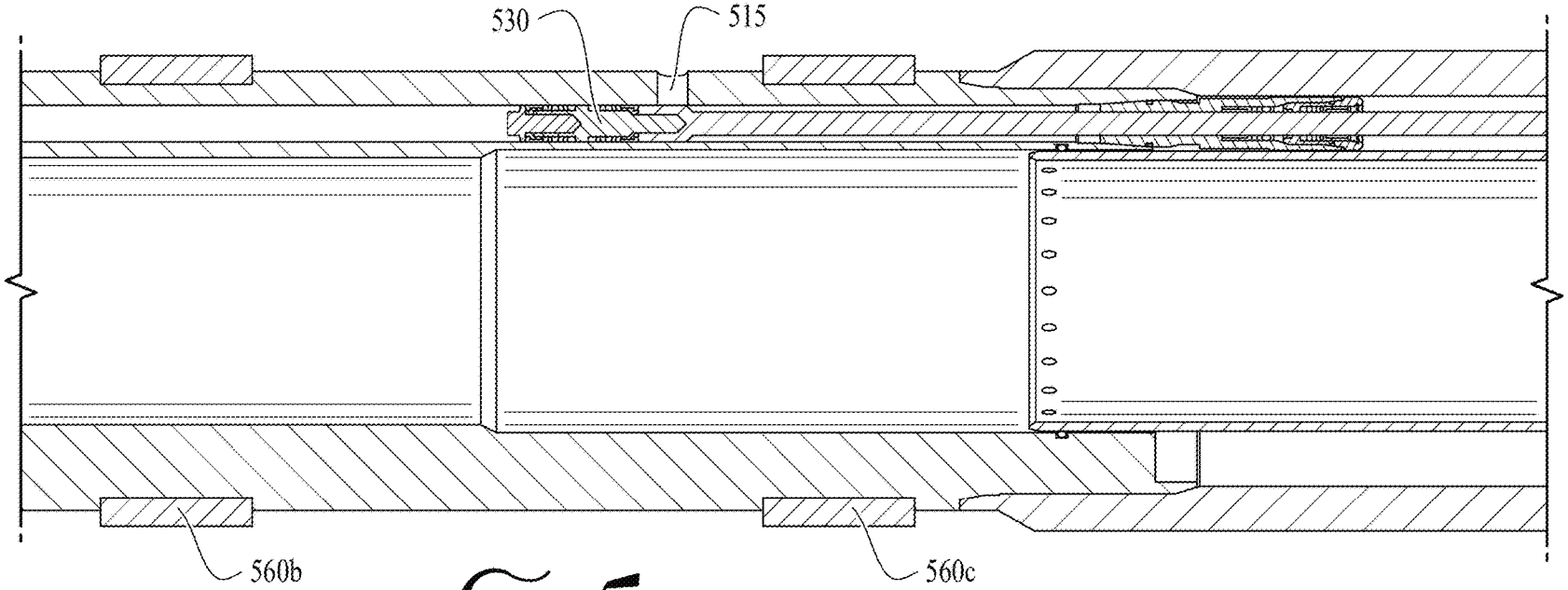

FIGS. 5A-5D illustrate an exemplary wireline retrievable safety valve (WRSV) 500. FIG. 5A illustrates a cross-sectional view of the WRSV 500 in closed configuration, oriented to show the control pressure aspects (e.g. for opening and closing the valve 540 of the WRSV 500), and FIG. 5B similarly illustrates the WRSV 500 control pressure aspects in open configuration. FIG. 5C illustrates another cross-sectional view of the WRSV 500 in closed configuration (e.g. similar to FIG. 5A, but shown on a different plane), oriented to show the balance pressure aspects (e.g. for counteracting hydrostatic pressure in the control line), and FIG. 5D similarly illustrates the WRSV 500 balance pressure aspects in open configuration. In embodiments, the WRSV 500 may be configured to be disposed within a TRSV 200 and to take over safety valve functionality from the TRSV 200, for example allowing effective hydraulic safety valve function if the TRSV 200 has malfunctioned.

The WRSV 500 comprises a body 501 having a bore 503 therethrough, a control port 510, and a balance port 515. In embodiments, the control port 510 and the balance port 515 open on the exterior of the body 501. Within the body 501, an operating piston 520 (e.g. having a head 525 and rod 527, see for example FIG. 7), a balance piston 530 (having a head 535 and a rod 537, see for example FIG. 7), and a valve 540 are disposed. The valve 540 is configured to have an open position (allowing flow through the bore 503) and a closed position (e.g. configured to close the bore 503). The control port 510 may be configured to be in fluid communication with the operating piston 520, and the balance port 515 may be configured to be in fluid communication with the balance piston 530.

As shown in FIGS. 5A-B, the valve 540 can be configured so that sufficient pressure (e.g. operating piston pressure can range from about 2000-5000 psi.) applied to the operating piston 520 through the control port 510 opens the valve 540. For example, pressure applied on the first side 521 of the operating piston 520 through the control port 510 can open the valve 540, and loss of pressure through the control port 510 may close the valve 540. In embodiments, the valve 540 can comprise a flapper valve (e.g. which may be biased closed), although alternate valves may be used in other embodiments. In embodiments, the operating piston 520 and the balance piston 530 can be linked to move (e.g. axially) together. For example, the operating piston 520 and the balance piston 530 may be linked by a connecting ring 550.

Figure 7:
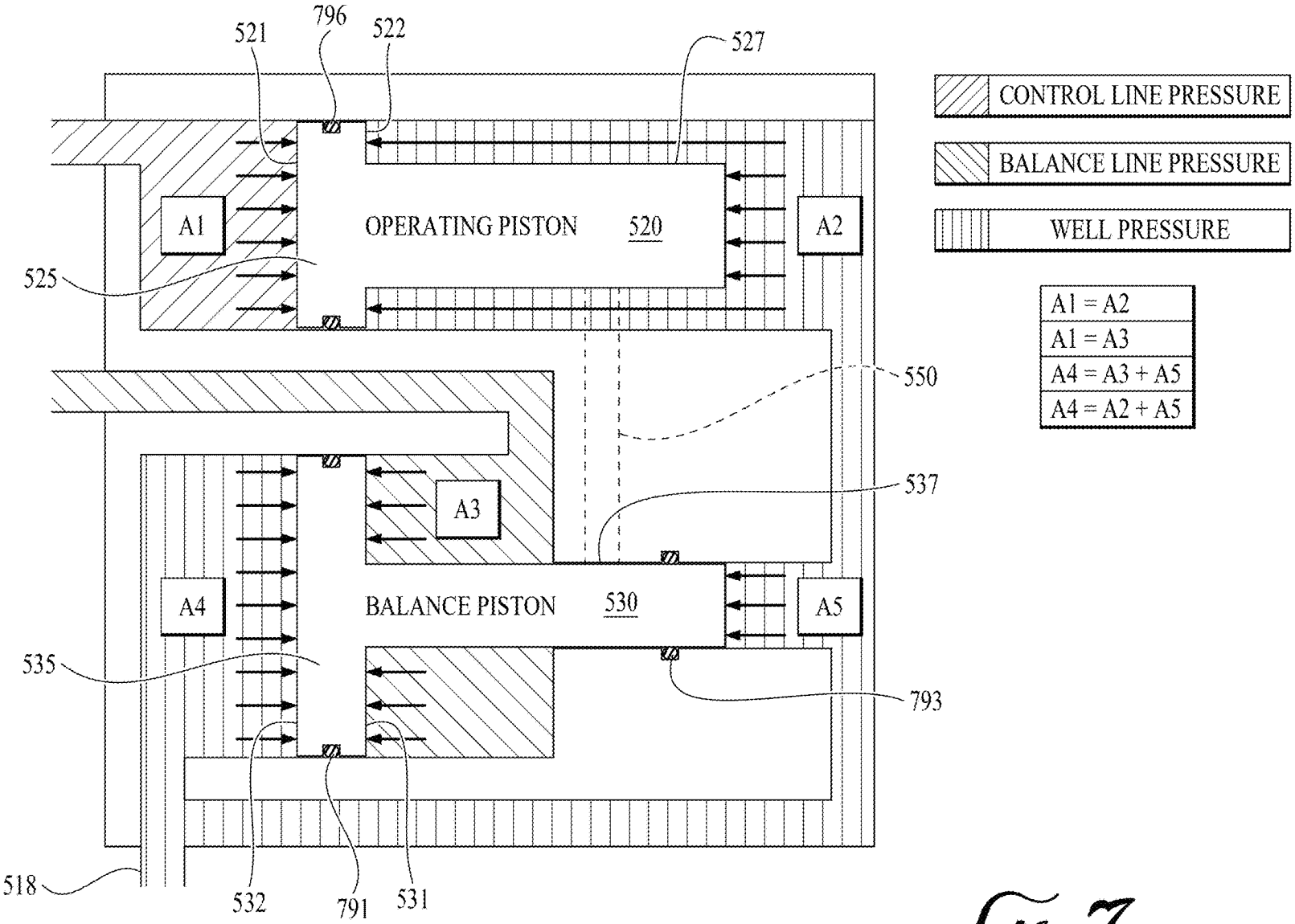
FIG. 7 schematically illustrates operation of an exemplary WRSV, according to an embodiment of the disclosure.

In embodiments (see for example FIG. 7), the control port 510 may be in fluid communication with a first side 521 of the operating piston 520 (e.g. a first side of the head 525 of the operating piston 520), the balance port 515 may be in fluid communication with a first side 531 of the balance piston head 535, a second side 522 of the operating piston 520 (e.g. opposite the first side 521 of the operating piston 520) and a second side 532 of the balance piston head 535 may be configured to be in fluid communication with the wellbore (e.g. through one or more wellbore pressure port 518), the balance piston rod 537 may extend outward from the first side 531 of the balance piston head 535, and the balance piston rod 537 (e.g. the distal end of the balance piston rod) may be configured to be in fluid communication with the wellbore (e.g. through the one or more wellbore pressure port 518). FIG. 7 provides an exemplary embodiment illustrating how the pressures (e.g. the control pressure, the balance pressure, and the wellbore pressure) in the WRSV 300 interact with the operating piston 520 and balance piston 530. In embodiments, the first side 521 of the operating piston 520 may be axially opposed to the first side 531 of the balance piston head 535 (e.g. and rod 537). For example, control pressure on the first side 521 of the operating piston 520 may act in opposition to pressure applied on the first side 531 of the balance piston head 535 and the rod 537 (e.g. balance pressure applied to the first side 531 of the balance piston head 535 and wellbore pressure applied to the balance piston rod 537). In embodiments, the balance piston 530 and operating piston 520 may be configured so that balance pressure is axially opposed to control/operating pressure (e.g. as communicated therebetween by the connecting ring 550). For example, pressure from the control port 510 may be configured to act downhole on the operating piston 520, and pressure from the balance port 515 may be configured to act uphole on the balance piston 530.

In embodiments, the first side 521 of the operating piston 520 has a first surface area, the second side 522 of the operating piston 520 has a second surface area, the first side 531 of the balance piston head 535 has a third surface area, the second side 532 of the balance piston head 525 has a fourth surface area, and the balance piston rod 537 has a fifth surface area (e.g. on the axial end of the rod). In embodiments, the first surface area can be approximately equal to the second surface area, the first surface area can be approximately equal to the third surface area, the fourth surface area can be approximately equal to the third surface area plus the fifth surface area, and the fourth surface area can be approximately equal to the second surface area plus the fifth surface area. As shown in FIG. 7, the operating piston 520 may comprise a head 525 and a rod 527, and the rod 527 can extend outward from the second side of the operating piston head 525. In embodiments, the second side 522 of the operating piston 520 may comprise both the second side of its head 525 and the rod 527 (e.g. both the second side of the operating piston head 525 and operating piston rod 527 are configured to be in fluid communication with the wellbore pressure opposite the first side 521 of the operating piston 520 and/or the second surface area comprises the surface area of the second side of the operating piston head 525 plus the (e.g. distal end) surface area of the operating head rod 527).

Figure 6A:
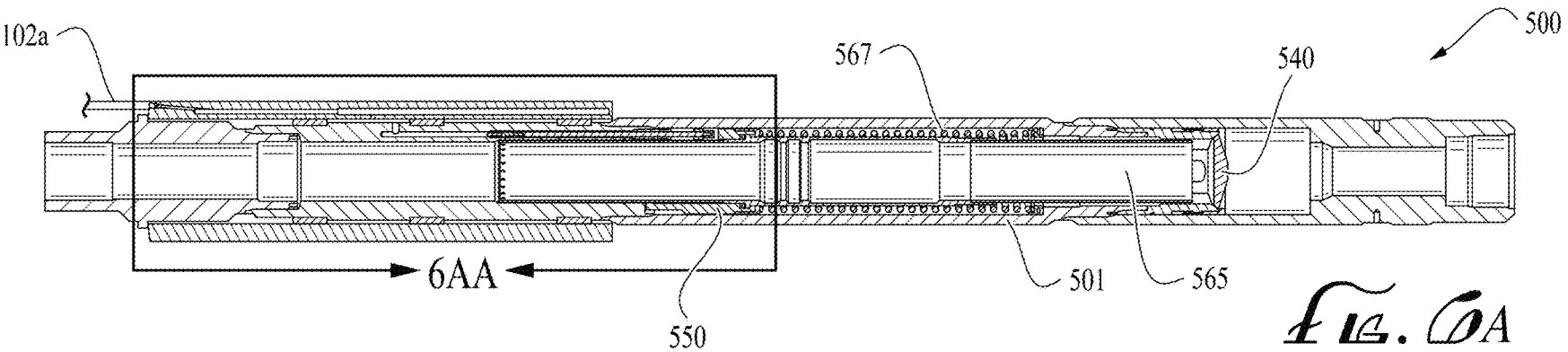
FIGS. 6A-B is a cross-sectional view schematically illustrating a system having an exemplary WRSV disposed within an exemplary TRSV, according to an embodiment of the disclosure (with FIG. 6AA illustrating an enlarged portion of FIG. 6A, and FIG. 6BB illustrating an enlarged portion of FIG. 6B)
Figure 6A:
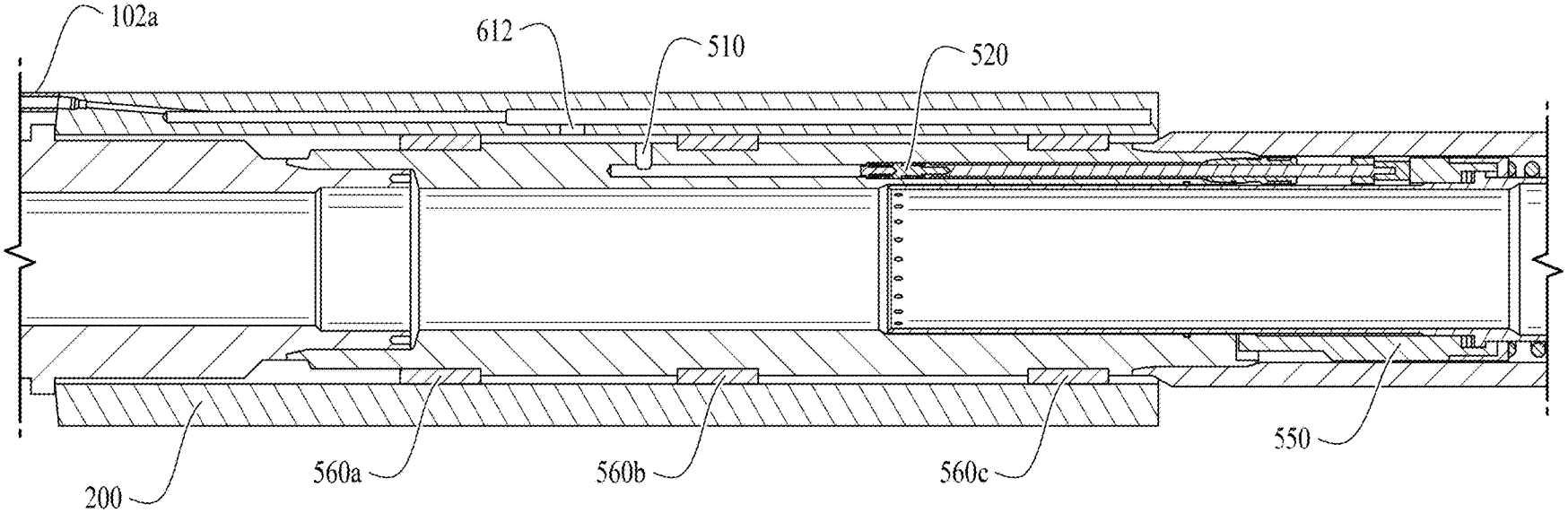
Figure 6B:
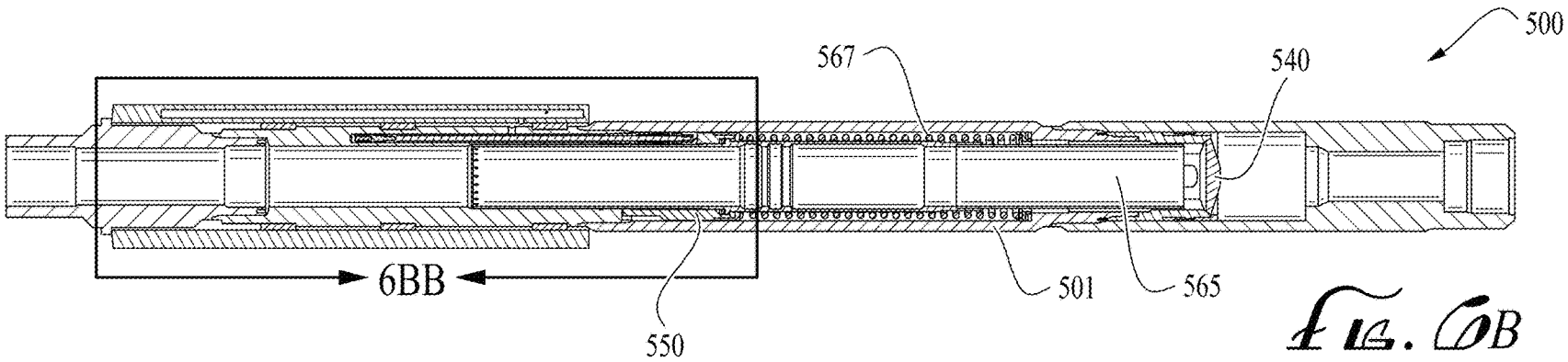
Figure 6B:
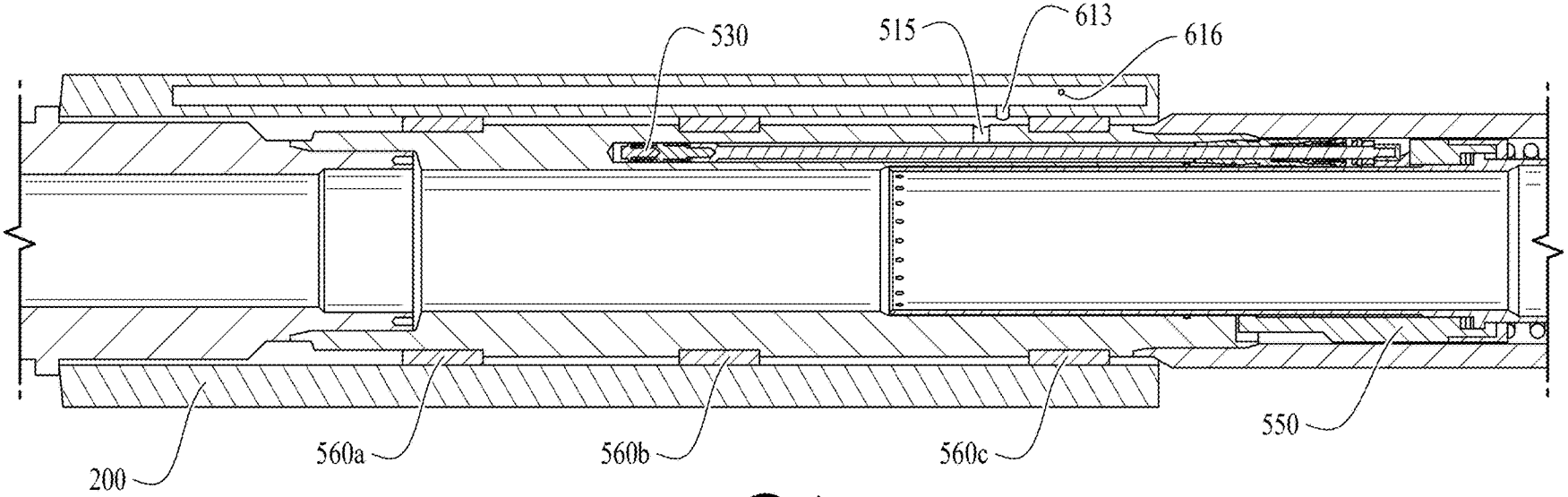

In embodiments, the body 501 can be configured to lock into a bore 298 of a tubing retrievable safety valve (such as TRSV 200 of FIG. 2A-B, which may be in fluid communication with a control line 102*a* and a balance line 102*b*, see for example FIGS. 6A-B). The body 501 can be configured to place the control port 510 in fluid communication with the control line 102*a* (e.g. through the TRSV) and the balance port 515 in fluid communication with the balance line 102*b* (e.g. through the TRSV), for example when the body 501 is locked in the bore 298 of the TRSV 200. Typically, the body 501 can be configured so that when locked into TRSV 200, the body 501 extends through the valve of the TRSV 200 to hold the valve open (e.g. body 501 configured to lock the TRSV 200 valve open when disposed in the TRSV 200).

In some embodiments, the body 501 may comprise a lock mandrel 573, while in other embodiments a separate lock mandrel 573 may be configured to axially fix the WRSV 500 in place within the TRSV 200 (e.g. at an appropriate location for communication between the control lines 102*a* and balance lines 102*b* of the TRSV 200 to the WRSV 500 and/or for holding the TRSV valve open). In some embodiments, the lock mandrel 573 can be disposed uphole of the body 501 (e.g. on the uphole end). In some embodiments, either the body 501 or the lock mandrel 573 may be configured for attachment to a wireline, for deployment downhole in a well. The lock mandrel 573 can be configured to seat on top of the TRSV 200 (e.g. on a top sub of the TRSV 200 and/or in proximity to the top of the TRSV 200). In embodiments, there may be an extension disposed between locking mandrel 573 and the body 501, to properly position the WRSV 500 within the TRSV 200 (e.g., with the control port 510 disposed in fluid communication with the control line 102*a* through the TRSV 200, and the balance port 515 disposed in fluid communication with the balance line 102*b* through the TRSV 200, and with the body 501 extending through the TRSV valve).

Figure 8:
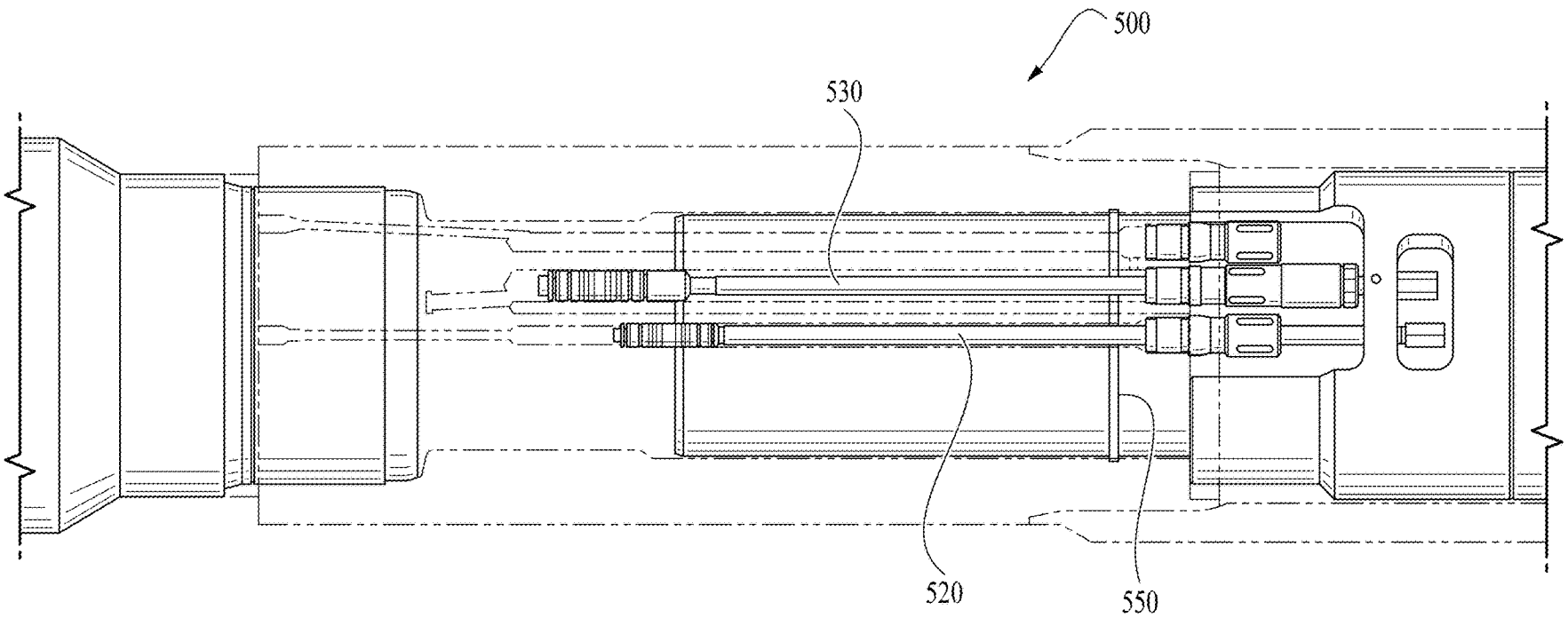
FIG. 8 illustrates via partial cut-away, a balance piston and an operating piston of an exemplary WRSV, according to an embodiment of the disclosure.

In embodiments, the balance port 515 and the control port 510 may be axially spaced on the body 501 (e.g. there is axial space therebetween). For example, the balance port 515 can be disposed downhole of the control port 510 (see for example FIG. 8, illustrating exemplary ports for exemplary balance piston 530 and exemplary operating piston 520). Some embodiments may further comprise three seals 560, for example with the first seal 560*a* disposed above/uphole of the control port 510, the second seal 560*b* disposed between the control port 510 and the balance port 515 (e.g. below the control port 510 and above the balance port 515), and the third seal 560*c* disposed below/downhole of the balance port 515. The three seals 560 may be configured to form two sealed spaces between the WRSV 500 and the TRSV 200, with the control port 510 disposed in the first sealed space (e.g. between the first and second seals 560*a* and 560*b*) and the balance port 515 disposed in the second sealed space (e.g. between the second and third seals 560*b* and 560*c*). This may facilitate transmission of control pressure from the control line 102*a*, through the TRSV 200, to the control port 510 of the WRSV 500 (e.g. and thereby to the operating piston 520 of the WRSV 500), as well as transmission of balance pressure from the balance line 102*b*, through the TRSV 200, to the balance port 515 of the WRSV 500 (e.g. and thereby to the balance piston 530 of the WRSV 500). In some embodiments, the seals 560 may be configured to provide radial space (e.g. circumferentially) between the WRSV 500 and the TRSV 200 (for example, at least in proximity to the control port 510 and balance port 515). Generally, each seal 560 may encircle the body 501 (e.g. configured to form a seal around the circumference of the WRSV 500 between the WRSV 500 and the TRSV 200 and/or to prevent axial fluid flow therepast). In embodiments, the first sealed space (e.g. between first and second seals 560*a* and 560*b*) can be configured to be in fluid communication with the TRSV control line 102*a*, and the second sealed space (e.g. between second and third seals 560*b* and 560*c*) can be configured to be in fluid communication with the TRSV balance line 102*b*.

In some embodiments, each piston of the WRSV 500 (e.g. the operating piston 520 and the balance piston 530) may comprise a (e.g. moving) seal configured to separate either the control or balance pressure from wellbore pressure. In embodiments, the balance piston 530 may have two such seals, for example a seal 791 on the balance piston head 535 and a seal 793 on the balance piston rod 537). In embodiments, the seal 796 on the operating piston 520 may be disposed on its head 525.

The WRSV 500 may further comprise a sliding sleeve 565 disposed within the body 501 (e.g. within the bore 503), having a first/closed position distal to (e.g. spaced from) the valve 540 (e.g. uphole, as shown in FIG. 5A) and a second/open position proximate to the valve 540 (e.g. downhole, as shown in FIG. 5C). For example, in the first position the sleeve 565 may be spaced axially from the valve 540, and in the second position the sleeve 565 may extend through the flapper valve 540 to hold it open. In embodiments, the sleeve 565 may be biased from the second/open position towards the first/closed position. For example, a spring 567 may be configured to bias the sleeve 565 from the second position to the first position. The spring 567 may be configured to provide sufficient spring force (e.g. upward/closing force) on the operating piston 520 to close the valve 540 and/or to translate the sleeve 565 to the first position when there is loss of control pressure. Due to the configuration with the balance pressure, the spring 567 may not have to overcome the hydrostatic pressure of the control line 102*a* in order to close the valve 540. In some embodiments, the valve 540 itself may be biased to close as well (e.g. so that when the sleeve 565 retracts, the valve 540 closes).

The operating piston 520 can be configured to move the sleeve 565 from the first position to the second position (e.g. based on application of control pressure from the control line 102*a*). In some embodiments, the connecting ring 550 may be disposed between the operating piston 520 and the spring 567 (e.g. so that the piston may drive/compress the spring 567 through contact with the connecting ring 550) and/or may be configured to drive/translate the sleeve 565 based on operating piston 520 movement/position. The connecting ring 550 may be configured so that axial movement of the operating piston 520 and balance piston 530 are linked (see for example FIG. 7 and FIG. 8).

As mentioned above, the WRSV 500 (e.g. as shown in FIGS. 5A-D) may be configured for insertion in and/or operation with a TRSV 200 (e.g. which may be similar to that shown in and described with respect to FIGS. 2A-4 in some embodiments). FIGS. 6A-B illustrate a system having a WRSV 500 and a TRSV 200, with FIG. 6A illustrating the control pressure aspects of the exemplary system and FIG. 6B illustrating the balance pressure aspects (for convenience, only portions of the TRSV 200 and WRSV 500 are shown). For example, a system may comprise a tubular string 110 having a TRSV 200 disposed therein, a WRSV 500 disposed (e.g. at least partially) in a bore 298 of the TRSV 200, a control line 102*a* providing control pressure from the surface to the TRSV 200, and a balance line 102*b* providing balance pressure from the surface to the TRSV 200. The WRSV 500 may be configured to hold the flapper valve 252 of the TRSV 200 open, for example with a portion of the WRSV body 501 extending through the flapper valve 252 of the TRSV 200 when the WRSV 500 is seated in and/or locked on the TRSV 200 (e.g. the WRSV 500 may extend downward from the top of the TRSV 200 sufficiently to extend through the flapper valve 252 of the TRSV 200). A control port 510 of the WRSV 500 may be in fluid communication with the control line 102*a* through the TRSV 200, and pressure applied through the control line 102*a* may be operable to open the valve 540 of the WRSV 500. A balance port 515 of the WRSV 500 may be in fluid communication with the balance line 102*b* through the TRSV 200. Typically, the TRSV valve 252 is no longer functional (has malfunctioned), and the WRSV 500 has taken over safety valve operations.

The loss of pressure through the control line 102*a* may be operable to close the valve 540 of the WRSV 500. In embodiments, the WRSV 500 may be similar to the example discussed above with respect to FIGS. 5A-D. In some embodiments, the TRSV 200 may comprise a TRSV operating piston (e.g. piston rod 208) in fluid communication with the control line 102*a* and a TRSV balance piston (e.g. compensating piston, which may be similar to the balance piston 530) in fluid communication with the balance line 102*b*. In some embodiments, the interaction between the TRSV control pressure and the TRSV balance pressure may be similar to the interactions described herein regarding the WRSV 500 control pressure and the WRSV 500 balance pressure. For example, the TRSV operating piston and TRSV balance piston can be mechanically linked to move axially together and may have pressure arranged on the pistons in a similar manner to the WRSV 500 (e.g. with the balance pressure axially opposed to the control pressure).

Figure 9:
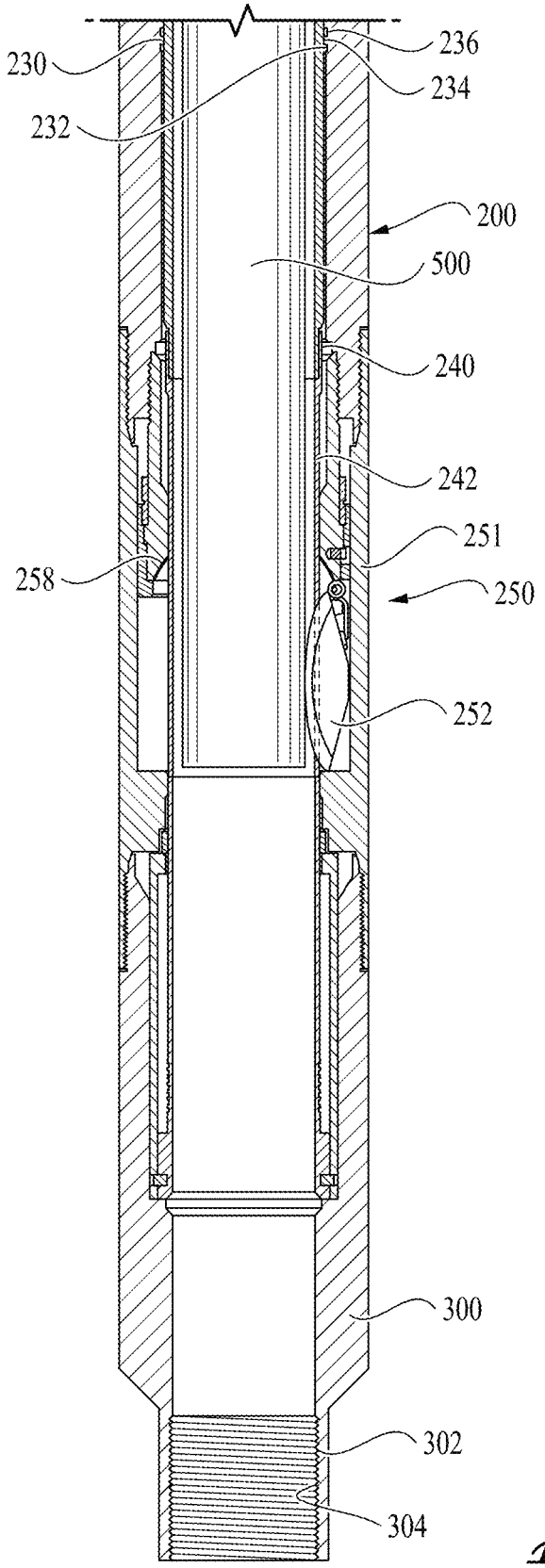
FIG. 9 illustrates via partial cut-away view an exemplary WRSV disposed within an exemplary TRSV, according to an embodiment of the disclosure.

When the WRSV 500 is seated in the TRSV 200, in addition to holding the valve of the TRSV 200 open (as shown in FIGS. 6A-B and FIG. 9), interaction of the three seals 560 on the WRSV 500 body 501 exterior with the bore/interior surface 298 of the TRSV 200 may form the sealed spaces therebetween to facilitate fluid communication between the TRSV 200 and the WRSV 500. As previously discussed, the control port 510 of the WRSV 500 may be disposed in the first sealed space, and the balance port 515 may be disposed in the second sealed space. As shown in the system of FIGS. 6A-B, a control pressure opening 612 (e.g. on the bore/interior surface 298) of the TRSV 200 may also be disposed in the first sealed space, and a balance pressure opening 613 (e.g. on the bore/interior surface 298) of the TRSV 200 may also be disposed in the second sealed space. The control pressure opening 612 of the TRSV 200 may be in fluid communication with the control line 102*a*, thereby providing fluid communication between the control line 102*a* from the surface and the control port 510 of the WRSV 500 (and thereby the operating piston 520 of the WRSV 500). The balance pressure opening 613 of the TRSV 200 may be in fluid communication with the balance line 102*b* (e.g. through bore opening 616), thereby providing fluid communication between the balance line 102*b* from the surface and the balance port 515 of the WRSV 500 (and thereby the balance piston 530 of the WRSV 500). The control pressure opening 612 and the balance pressure opening 613 of the TRSV 200 may be axially spaced, for example similarly to the control port 510 and balance port 515 of the WRSV 500 (e.g. so that corresponding openings and ports are disposed in the same sealed space, formed by the three seals 560).

Typically, prior to failure of valve 252 and/or insertion of the WRSV 500, the TRSV 200 may not have had the control pressure opening 612 or the balance pressure opening 613 (e.g. there may have been no fluid communication between either the control or balance line 102*b* and the bore 298 of the TRSV 200). In some embodiments, after failure of the TRSV 200 and/or prior to insertion of the WRSV 500, the control pressure opening 612 and the balance pressure opening 613 may be opened (so that when seated, the fluid communication between the TRSV 200 and the WRSV 500 is possible).

For example, a radial cutting tool may be inserted into the central bore of the TRSV 200. The radial cutting tool may use any one of several cutting techniques that are well known in the art including, but not limited to, chemical cutting, thermal cutting, mechanical cutting, explosive cutting or the like. For example, the radial cutting tool may be a chemical cutter that is lowered through tubing/conduit from the surface into the center/bore of the TRSV 200. The position of radial cutting tool within the TRSV 200 may be determined by engagement of a locator section of radial cutting tool with one or more landing nipple within tubing. Once in place, the radial cutting tool can be operated to cut through a portion of the bore wall of the TRSV 200, to form the control pressure opening 612 and/or balance pressure opening 613 (e.g. to open fluid communication between the control piston (e.g. piston rod 208) and the bore 298 of the TRSV 200 and/or the balance piston (e.g. compensating piston) and the bore 298 of the TRSV 200 respectively). For example, a 360-degree cut may be made into the surrounding material (e.g. the bore wall). Radial cutting tool may normally be controlled at the surface. The depth of cut made by the radial cutting tool can be predetermined (e.g. based on the geometry of the TRSV 200). The radial cutting tool can be set to make a cut deep enough to penetrate through a portion of the bore wall to form the control and/or balance pressure opening 612, 613, while still shallow enough to maintain the integrity of the TRSV 200. Typically, two cuts axially spaced apart would be made to form the control pressure opening 612 and the balance pressure opening 613. Once the control pressure opening 612 and/or balance pressure opening 613 has been created, the radial cutting tool can be retrieved to the surface. The WRSV 500 can then be lowered into the central bore 298 of TRSV 200, seating as shown in FIGS. 6A-B.

In some embodiments, one or more through-port (e.g. control pressure opening 612 and/or balance pressure opening 613) may be formed on the bore wall of the TRSV 200 to establish fluid communication between the control line 102*a* and the control port 510 of the WRSV 500 and the balance line 102*b* and the balance port 515 of the WRSV 500 (through the TRSV 200). Pressurized control fluid may then be used to control the WRSV 500 later disposed in the valve body 501 of the TRSV 200. In one example, the bore wall may be puncturable to form the through-port on the bore wall. Typically, the through port(s) would be formed on a separate trip prior to installing a WRSV 500 in the TRSV 200.

In some embodiments, the TRSV 200 may have a first removable (e.g. rupturable or shearable) plug and a second removeable plug (e.g. rupturable or shearable), wherein the first plug seals a first passage in the TRSV 200 providing fluid communication from the control line 102*a* to the interior surface/bore of the TRSV 200 (e.g. sealing the control pressure opening 612 of the TRSV 200), and the second plug seals a second passage providing fluid communication from the balance line 102*b* to the interior surface/bore of the TRSV 200 (e.g. sealing the balance pressure opening 613 of the TRSV 200). Typically, the first plug and the second plug may be axially spaced apart, for example with the first plug disposed axially uphole/above the second plug. In embodiments, the first and second plugs prevent fluid communication therethrough when closed, but are configured to be removed/opened, thereby providing fluid communication therethrough (e.g. when the TRSV 200 has failed and/or the WRSV 500 is to be used to replace TRSV 200 functionality). In some embodiments, the control pressure opening 612 and/or the balance pressure opening 613 may be opened prior to insertion of the WRSV 500 into the TRSV 200, but in other embodiments the control pressure opening 612 and/or balance pressure opening 613 may be opened during or after insertion of the WRSV 500 into the TRSV 200.

In embodiments, the TRSV 200 may be disposed within (e.g. made up as part of) a tubular string 110, configured for insertion downhole from the surface of the well. In embodiments, the system may include a pressure source, such as a pump which may be at the surface. In embodiments, the system may comprise a wireline, which may extend downward from the surface into the wellbore and/or is configured to position the WRSV 500 in the wellbore/TRSV 200). For example, the WRSV 500 can be disposed at the distal/downhole end of the wireline. In embodiments, the balance pressure can be set to overcome hydrostatic pressure in the control line 102*a*. In embodiments, the spring 567 may not have to overcome hydrostatic pressure of the control line 102*a* to close the valve 540.

Disclosed embodiments further include methods of providing safety valve functionality in a wellbore (e.g. when a TRSV fails). For example, a method may comprise seating a WRSV in a bore of a TRSV disposed in the wellbore, wherein a control line provides control pressure to the TRSV and a balance line provides balance pressure to the TRSV; and providing fluid communication between the control line and an operating piston of the WRSV through the TRSV, and providing fluid communication between the balance line and a balance piston of the WRSV through the TRSV. In embodiments, a valve of the TRSV is not operational (e.g. the TRSV no longer functions effectively as a safety valve). Some method embodiments further comprise determining that the valve of the TRSV is no longer functional/operational. In embodiments, the TRSV and/or WRSV may be one of the embodiments disclosed herein. For example, the operating piston and the balance piston of the WRSV can be linked to move (e.g. axially) together and/or pressure from the control line on the operating piston may be axially opposed to pressure from the balance line on the balance piston.

Some method embodiments may further comprise providing wellbore pressure to each of the operating piston and the balance piston, with the wellbore pressure on the operating piston axially opposed to the wellbore pressure on the balance piston. Some embodiments may have wellbore pressure provided to the operating piston opposite the pressure from the control line, and wellbore pressure provided to the balance piston opposite the pressure from the balance line. For example, in embodiments the pressures may be applied similar to that shown in FIG. 7. Method embodiments may further comprise providing balance pressure through the balance line sufficient to overcome hydrostatic pressure of the control line. Embodiments may further comprise providing control pressure through the control line to open a valve of the WRSV. Method embodiments may further comprise, upon loss of pressure in the control line, closing the valve of the WRSV.

In embodiments, providing fluid communication between the control line and an operating piston of the WRSV through the TRSV may comprise opening a first flowpath (e.g. a control pressure opening) through the TRSV (e.g. providing fluid communication from the control line to the bore of the TRSV) and/or providing fluid communication between the balance line and a balance piston of the WRSV through the TRSV may comprise opening a second flowpath (e.g. a balance pressure opening) through the TRSV (e.g. providing fluid communication from the balance line to the bore of the TRSV). An exit for the first flowpath (e.g. the control pressure opening) can be axially offset from an exit for the second flowpath (e.g. the balance pressure opening). In some embodiments, opening the first and second fluid flowpaths (e.g. the control pressure opening and balance pressure opening) may comprise rupturing or shearing a plug (e.g. before seating the WRSV in the TRSV). In other embodiments, opening the first and second fluid flowpath may comprise, prior to seating the WRSV in the TRSV, cutting the first and second fluid flowpath (e.g. the control pressure opening and balance pressure opening) in the interior surface/bore of the TRSV (e.g. using a cutting tool). In embodiments, the control pressure opening and balance pressure opening may each extend 360 degrees around the bore of the TRSV.

In embodiments, seating the WRSV in the bore of the TRSV may hold/fix open the valve in the TRSV (e.g. with the WRSV extending through the valve of the TRSV). In some embodiments, seating the WRSV in the bore of the TRSV may provide sealing between the WRSV and the TRSV (e.g. providing the first sealed space between the TRSV and WRSV through which fluid communication between the control line and the WRSV through the TRSV occurs, and providing the second sealed space between the TRSV and WRSV through which fluid communication between the balance line and the WRSV through the TRSV occurs). In embodiments, the TRSV is disposed in a tubing string disposed downhole in a well. In embodiments, the TRSV and/or WRSV may be disposed at deep set depths within a well, for example depths greater than approximately 7,000 ft., greater than approximately 9,000 ft., approximately 7,000-12,000, approximately 7,000-9,000 ft., or approximately 9,000-12,000 ft.

Disclosed embodiments also include methods of making a WRSV. For example, a method of making of WRSV may comprise placing an operating piston in fluid communication with a control port; placing a balance piston in fluid communication with a balance port; placing one or more wellbore pressure port in fluid communication with both the operating piston and the balance piston; and linking the operating piston and the balance piston to move axially together. In embodiments, pressure from the control port on the operating piston may be axially opposed to pressure from the balance port on the balance piston, pressure from the one or more wellbore pressure port on the operating piston may be opposite pressure from the control port, and/or pressure from the one or more wellbore pressure port on the balance piston may be opposite pressure from the balance port. Method embodiments may further comprise providing a body having a longitudinal bore therethrough, and disposing a valve in the bore, wherein pressure from the control port is operable to open the valve (e.g. actuation of the operating piston opens the valve), and a loss of pressure through the control port is operable to close the valve. Embodiments may further comprise forming or disposing the control port and the balance port in the body. In embodiments, there may be no fluid communication between the operating piston and/or balance piston and the bore 503 of the WRSV.

Embodiments may also include providing a sliding sleeve in the bore, wherein the sliding sleeve has a closed position and an open position, in the open position the sleeve extends through the valve and/or opens the valve, and the sleeve is biased from the open position towards the closed position. In embodiments, the operating piston can be configured to translate the sleeve from the closed position to the open position (e.g. responsive to application of sufficient pressure through the control port). Embodiments may further comprise providing a spring configured to bias the sleeve towards the closed position. In embodiments, the spring may not have to overcome hydrostatic pressure of the control line. In embodiments, the spring force along with the force from the balance pressure may cause the valve to close upon loss of control pressure.

Embodiments may further comprise providing three seals on an exterior of the body, each configured to seal between the body and a TRSV into which the WRSV is configured to seat. In embodiments, the control port and the balance port are configured to open/be in fluid communication with the exterior of the WRSV (e.g. to be in fluid communication with the bore of the TRSV into which the WRSV is seated), the control port is disposed between the first and second seals, and the balance port is disposed between the second and third seals. Some embodiments comprise forming the body to seat/lock into the TRSV bore so as to lock open the TRSV valve and to place the control port and balance port in the proper axial location for fluid communication with the control line and the balance line (through the TRSV). In some embodiments, forming the body may comprise attaching a locking mandrel and/or extension to the body (e.g. at an upper end).

In some embodiments, a first side of the operating piston may have a first surface area, a second side of the operating piston may have a second surface area, a first side of the balance piston head may have a third surface area, a second side of the balance piston head may have a fourth surface area, and a balance piston rod may have a fifth surface area (e.g. on the axial end of the rod); and the first surface area may be approximately equal to the second surface area, the first surface area may be approximately equal to the third surface area, the fourth surface area may be approximately equal to the third surface area plus the fifth surface area, and the fourth surface area may be approximately equal to the second surface area plus the fifth surface area. In some embodiments, the control port can be in fluid communication with a first side of the operating piston (e.g. a first side of the head of the operating piston), the balance port can be in fluid communication with a first side of the balance piston head, a second side of the operating piston (e.g. opposite the first side of the operating piston) and a second side of the balance piston head can be configured to be in fluid communication with the one or more wellbore pressure port, the balance piston rod can extends outward from the first side of the balance piston head, and the balance piston rod can be configured to be in fluid communication with the one or more wellbore pressure port. Some embodiments comprise forming fluid pathways though the body to provide pressures as described above. Some embodiments comprise linking the operating piston and balance piston with a connecting ring, wherein the operating piston and balance piston move axially together.

The disclosed WRSV embodiments may allow for safety valve functionality to be restored to a malfunctioning TRSV, for example without having to remove the TRSV and/or tubular string from the wellbore. For example, the WRSV can be inserted while the TRSV is downhole. In embodiments, the WRSV may be operated using the hydraulic line(s) originally used to operate the TRSV. Thus, no new hydraulic lines may be required when using such a WRSV to address a malfunctioning TRSV. Additionally, the disclosed WRSV may be tubing pressure insensitive, for example allowing effective operation in deep set applications by compensating for hydrostatic pressure in the control line. Accordingly, long springs may not be necessary to effectively operate the valve at depth, which may allow for the WRSV to have a shorter length. These and other advantages of disclosed embodiments will be apparent to persons of skill.

ADDITIONAL DISCLOSURE

The following are non-limiting, specific embodiments in accordance with the present disclosure:

In a first embodiment, a safety valve comprises: a body having a bore therethrough, a control port, and a balance port; an operating piston; a balance piston having a head and a rod; and a valve having an open position (allowing flow through the bore) and a closed position (e.g. configured to close the bore); wherein: the control port is in fluid communication with a first side of the operating piston (e.g. a first side of the head of the operating piston); the balance port is in fluid communication with a first side of the balance piston head; a second side of the operating piston (e.g. opposite the first side of the operating piston) and a second side of the balance piston head are configured to be in fluid communication with the wellbore (e.g. through one or more wellbore pressure port); the balance piston rod extends outward from the first side of the balance piston head; the balance piston rod is configured to be in fluid communication with the wellbore (e.g. through the one or more wellbore pressure port); the operating piston and the balance piston are linked to move (e.g. axially) together; and the valve is configured so that sufficient pressure (e.g. approximately 1,800-7,000 psi; 2,000-5,000 psi; 1,800-2,000 psi; 1,800-5,000 psi; 2,000-7,000 psi; or 5,000-7,000 psi, which may depend on the product and/or well specifics) applied to the operating piston through the control port opens the valve.

A second embodiment can include the safety valve of the first embodiment, wherein the safety valve is configured for attachment to a wireline (e.g. at the uphole end of the body).

A third embodiment can include the safety valve of the first or second embodiments, wherein the first side of the operating piston is axially opposed to the first side of the balance piston head (e.g. and rod) (e.g. control pressure on the first side of the operating piston acts in opposition to pressure applied on the first side of the balance piston head and the rod) (wherein the balance piston and operating piston are configured so that balance pressure is axially opposed to control/operating pressure—e.g. as communicated therebetween by the connecting ring)) (e.g, wherein pressure from the control port is configured to act downhole on the operating piston, and pressure from the balance port is configured to act uphole on the balance piston).

A fourth embodiment can include the safety valve of any one of the first to third embodiments, wherein the first side of the operating piston has a first surface area, the second side of the operating piston has a second surface area, the first side of the balance piston head has a third surface area, the second side of the balance piston head has a fourth surface area, and the balance piston rod has a fifth surface area (e.g. on the axial end of the rod); and wherein the first surface area is approximately equal to the second surface area, the first surface area is approximately equal to the third surface area, the fourth surface area is approximately equal to the third surface area plus the fifth surface area, and the fourth surface area is approximately equal to the second surface area plus the fifth surface area.

A fifth embodiment can include the safety valve of any one of the first to fourth embodiments, wherein the operating piston comprises a head and a rod, the rod extends outward from the second side of the operating piston head, and the second side of the operating piston comprises both the second side of its head and the rod (e.g. both the second side of the operating piston head and operating piston rod are configured to be in fluid communication with the wellbore pressure opposite the first side of the operating piston and/or the second surface area comprises the surface area of the second side of the operating piston head plus the (e.g. distal) surface area of the operating head rod).

A sixth embodiment can include the safety valve of any one of the first to fifth embodiments, wherein the operating piston and the balance piston are linked by a connecting ring.

A seventh embodiment can include the safety valve of any one of the sixth embodiment, wherein the connecting ring may be disposed between the operating piston and the spring (e.g. so that the piston may drive/compress the spring through contact with the connecting ring) and/or may be configured to drive/translate the sleeve based on operating piston movement/position.

An eighth embodiment can include the safety valve of any one of the first to seventh embodiments, wherein the body is configured to lock into a bore of a tubing retrievable safety valve, wherein the tubing retrievable safety valve is in fluid communication with a control line and a balance line.

A ninth embodiment can include the safety valve of any one of the first to eighth embodiments, wherein the body is configured to place the control port in fluid communication with the control line and the balance port in fluid communication with the balance line (e.g. when the body is locked in the bore of the TRSV).

A tenth embodiment can include the safety valve of any one of the first to ninth embodiments, wherein the body is configured so that when locked into TRSV, the body extends through the valve to hold the valve open (e.g. body configured to lock the TRSV valve open when disposed in the TRSV).

An eleventh embodiment can include the safety valve of any one of the first to tenth embodiments, wherein pressure applied on the first side of the operating valve through the control port opens the valve, and loss of pressure through the control port closes the valve.

A twelfth embodiment can include the safety valve of any one of the first to eleventh embodiments, wherein the valve comprises a flapper valve.

A thirteenth embodiment can include the safety valve of any one of the first to twelfth embodiments, wherein the balance port and the control port are axially spaced (e.g. there is an axial space therebetween).

A fourteenth embodiment can include the safety valve of any one of the first to thirteenth embodiments, wherein the balance port is disposed downhole of the control port.

A fifteenth embodiment can include the safety valve of any one of the first to fourteenth embodiments, further comprising three seals, wherein the first seal is disposed above/uphole of the control port, the second seal is disposed between the control port and the balance port (e.g. below the control port and above the balance port), and the third seal is disposed below/downhole of the balance port.

A sixteenth embodiment can include the safety valve of any one of the first to fifteenth embodiments, wherein the three seals are configured to form two sealed spaces between the WRSV and the TRSV, wherein the control port is disposed in a first sealed space and the balance port is disposed in a second sealed space.

A seventeenth embodiment can include the safety valve of any one of the first to sixteenth embodiments, wherein the seals are configured to provide radial space (e.g. circumferentially) between the WRSV and the TRSV (at least in proximity to the control and balance ports).

An eighteenth embodiment can include the safety valve of any one of the first to seventeenth embodiments, wherein each seal encircles the body (e.g. configured to form a seal around the circumference of the WRSV between the WRSV and the TRSV).

A nineteenth embodiment can include the safety valve of any one of the first to eighteenth embodiments, wherein exterior space between first and second seals is configured to be in fluid communication with a TRSV control line, and exterior space between second and third seals is configured to be in fluid communication with a TRSV balance line.

A twentieth embodiment can include the safety valve of any one of the first to nineteenth embodiments, wherein each piston comprises a (e.g. moving) seal configured to separate control/balance pressure from wellbore pressure.

A twenty-first embodiment can include the safety valve of the twentieth embodiment, wherein the balance piston comprises two such seals (e.g. one on the head and one on the rod).

A twenty-second embodiment can include the safety valve of any one of the first to twenty-first embodiments, further comprising a lock mandrel configured to axially fix WRSV in place within TRSV (e.g. at appropriate location for communication between control lines and balance lines of TRSV to WRSV).

A twenty-third embodiment can include the safety valve of any one of the first to twenty-second embodiments, wherein the lock mandrel is disposed uphole of the body.

A twenty-fourth embodiment can include the safety valve of any one of the first to twenty-third embodiments, wherein the lock mandrel is configured to seat on top of TRSV (e.g. on top sub of TRSV).

A twenty-fifth embodiment can include the safety valve of any one of the first to twenty-fourth embodiments, further comprising an extension, wherein the extension is disposed between the locking mandrel and the body and/or is configured to properly position the body within a TRSV (e.g., with control port disposed in fluid communication with the control line through the TRSV, and the balance port disposed in fluid communication with the balance line through the TRSV).

A twenty-sixth embodiment can include the safety valve of any one of the first to twenty-fifth embodiments, further comprising: a sliding sleeve disposed within the body, having a first/closed position uphole and a second/open position downhole, wherein in the second position the sleeve extends through the flapper valve to hold it open, and the operating piston is configured to move the sleeve from the first position to the second position; and a spring configured to bias the sleeve from the second position towards the first position.

A twenty-seventh embodiment can include the safety valve of any one of the first to twenty-sixth embodiments, wherein the spring provides sufficient spring force (e.g. upward force) on the operating piston to close the valve and/or translate the sleeve to the first position when there is loss of control pressure.

A twenty-eighth embodiment can include the safety valve of any one of the first to twenty-seventh embodiments, wherein the spring does not have to overcome hydrostatic pressure of the control line to close the valve (e.g. the balance pressure can address hydro-static pressure of the control line, such that the spring can be selected and/or configured without having to address/compensate for hydro-static pressure-a closing force which is tubing/wellbore pressure insensitive).

A twenty-ninth embodiment can include the safety valve of any one of the first to twenty-eighth embodiments, wherein the body further comprises a wellbore pressure port (e.g. configured to provide wellbore pressure to the balance piston and operating piston).

In a thirtieth embodiment, a safety valve for use in a wellbore, comprises: a body having a bore therethrough, a control port, and a balance port; an operating piston in fluid communication with the control port; a balance piston in fluid communication with the balance port; and a valve having an open position (allowing flow through the bore) and a closed position (e.g. configured to close the bore); wherein: the operating piston and the balance piston are linked to move (e.g. axially) together; pressure from the control port on the operating piston is axially opposed to pressure from the balance port on the balance piston; and the valve is configured so that sufficient pressure (e.g. approximately 1,800-7,000 psi; 2,000-5,000 psi; 1,800-2,000 psi; 1,800-5,000 psi; 2,000-7,000 psi; or 5,000-7,000 psi, which may depend on the product and/or well specifics) applied to the operating piston through the control port opens the valve.

A thirty-first embodiment can include the safety valve of the thirtieth embodiment, wherein wellbore pressure is applied to each of the operating piston and the balance piston.

A thirty-second embodiment can include the safety valve of any one of the thirtieth to thirty-first embodiments, wherein the wellbore pressure on the operating piston is axially opposed to the wellbore pressure on the balance piston.

A thirty-third embodiment can include the safety valve of any one of the thirtieth to thirty-second embodiments, wherein pressure from the control port is configured to act downhole on the operating piston, and pressure from the balance port is configured to act uphole on the balance piston.

A thirty-fourth embodiment can include the safety valve of any one of the thirtieth to thirty-third embodiments, wherein wellbore pressure is applied to the operating piston opposite the pressure from the control port, and wellbore pressure is applied to the balance piston opposite the pressure from the balance port.

A thirty-fifth embodiment can include the safety valve of any one of the thirtieth to thirty-fourth embodiments, wherein a surface area of the operating piston on which control pressure is applied is approximately equal to an opposing surface area of the operating piston on which wellbore pressure is applied.

A thirty-sixth embodiment can include the safety valve of any one of the thirtieth to thirty-fifth embodiments, wherein the surface area of the operating piston on which control pressure is applied is approximately equal to a surface area of the balance piston on which balance pressure is applied.

A thirty-seventh embodiment can include the safety valve of any one of the thirtieth to thirty-sixth embodiments, wherein the balance piston comprises a head and a rod, and a surface area of the balance piston head (e.g. on which wellbore pressure is applied in opposition to the balance pressure) is approximately equal to the surface area of the operating piston on which wellbore pressure is applied and a surface area of the balance piston rod (e.g. the sum).

A thirty-eighth embodiment can include the safety valve of any one of the thirtieth to thirty-seventh embodiments, wherein the surface area of the balance piston head (e.g. on which wellbore pressure is applied in opposition to the balance pressure, which is applied on the opposite side of the balance piston head) is approximately equal to the surface area of the balance piston on which balance pressure is applied (e.g. the side of the balance piston head opposite the wellbore pressure) and the surface area of the balance piston rod.

A thirty-ninth embodiment can include the safety valve of any one of the thirtieth to thirty-eighth embodiments, wherein wellbore pressure is further applied to the balance piston rod.

A fortieth embodiment can include the safety valve of any one of the thirtieth to thirty-ninth embodiments, wherein the body is configured to place the control port in fluid communication with a control line and the balance port in fluid communication with a balance line (e.g. when the body is locked in the bore of the TRSV).

A forty-first embodiment can include the safety valve of any one of the thirtieth to fortieth embodiments, wherein the body is configured so that when locked into a TRSV, the body extends through the valve to hold the valve open (e.g. body configured to lock the TRSV valve open when disposed in the TRSV).

A forty-second embodiment can include the safety valve of any one of the thirtieth to forty-first embodiments, wherein the balance port and the control port are axially spaced (e.g. there is an axial space therebetween).

A forty-third embodiment can include the safety valve of any one of the thirtieth to forty-second embodiments, wherein the balance port of the WRSV is configured to fluidly couple to a balance line through a TRSV, and the control port is configured to fluidly couple to a control line through the TRSV (e.g. when the WRSV is seated in the TRSV).

A forty-fourth embodiment can include the safety valve of any one of the thirtieth to forty-third embodiments, further comprising three seals, wherein the three seals are configured to form two sealed spaces between the WRSV and the TRSV, wherein the control port is disposed in a first sealed space and the balance port is disposed in a second sealed space.

A forty-fifth embodiment can include the safety valve of any one of the thirtieth to forty-fourth embodiments, further comprising: a spring configured to bias the valve from the second position towards the first position, wherein the spring does not have to overcome hydrostatic pressure of the control line to close the valve.

In a forty-sixth embodiment, a system comprises: a tubular string having a TRSV disposed therein; a WRSV disposed in a bore of the TRSV; a control line providing control pressure from the surface to the TRSV; and a balance line providing balance pressure from the surface to the TRSV; wherein: the WRSV holds a flapper valve of the TRSV open; a control port of the WRSV is in fluid communication with the control line through the TRSV; a balance port of the WRSV is in fluid communication with the balance line through the TRSV; and pressure applied through the control line is operable to open a valve of the WRSV.

A forty-seventh embodiment can include the system of the forty-sixth embodiment, wherein the TRSV valve is no longer functional (e.g. has malfunctioned).

A forty-eighth embodiment can include the system of any one of the forty-sixth to forty-seventh embodiments, wherein the valve of the WRSV comprises a flapper valve.

A forty-ninth embodiment can include the system of any one of the forty-sixth to forty-eighth embodiments, wherein loss of pressure through the control line is operable to close the valve of the WRSV.

A fiftieth embodiment can include the system of any one of the forty-sixth to forty-ninth embodiments, wherein the TRSV comprises a TRSV operating piston in fluid communication with the control line and a TRSV balance piston in fluid communication with the balance line.

A fifty-first embodiment can include the system of any one of the forty-sixth to fiftieth embodiments, wherein the TRSV operating piston and TRSV balance piston are mechanically linked to move axially together.

A fifty-second embodiment can include the system of any one of the forty-sixth to fifty-first embodiments, further comprising a pressure source (e.g. one or more pump, for example at the surface and/or configured to provide control pressure to the control line and/or balance pressure to the balance line).

A fifty-third embodiment can include the system of any one of the forty-sixth to fifty-second embodiments, wherein the WRSV comprises one of the first to forty-fifth embodiments).

A fifty-fourth embodiment can include the system of any one of the forty-sixth to fifty-third embodiments, wherein balance pressure (e.g. from the balance line) is set to overcome hydrostatic pressure of the control line (e.g, wherein the spring does not have to overcome hydrostatic pressure of the control line to close the valve).

A fifty-fifth embodiment can include the system of any one of the forty-sixth to fifty-fourth embodiments, further comprising a wireline, wherein the wireline extends downward from the surface into the wellbore (and is configured to position the WRSV in the wellbore/TRSV), and the WRSV is disposed at the distal/downhole end of the wireline.

In a fifty-sixth embodiment, a method of providing safety valve functionality in a wellbore, comprising: seating a WRSV in a bore of a TRSV disposed in the wellbore, wherein a control line provides control pressure to the TRSV and a balance line provides balance pressure to the TRSV; providing fluid communication between the control line and an operating piston of the WRSV through the TRSV; and providing fluid communication between the balance line and a balance piston of the WRSV through the TRSV.

A fifty-seventh embodiment can include the method of the fifty-sixth embodiment, wherein a valve of the TRSV is not operational (e.g. TRSV no longer functions effectively as a safety valve) (e.g. determining that the valve of the TRSV is no longer functional/operational).

A fifty-eighth embodiment can include the method of any one of the fifty-sixth to fifty-seventh embodiments, wherein the operating piston and the balance piston of the WRSV are linked to move (e.g. axially) together.

A fifty-ninth embodiment can include the method of any one of the fifty-sixth to fifty-eighth embodiments, wherein pressure from the control line on the operating piston is axially opposed to pressure from the balance line on the balance piston.

A sixtieth embodiment can include the method of any one of the fifty-sixth to fifty-ninth embodiments, further comprising providing wellbore pressure to each of the operating piston and the balance piston, with the wellbore pressure on the operating piston axially opposed to the wellbore pressure on the balance piston.

A sixty-first embodiment can include the method of any one of the fifty-sixth to sixtieth embodiments, wherein wellbore pressure provided to the operating piston is opposite the pressure from the control line, and wellbore pressure provided to the balance piston is opposite the pressure from the balance line.

A sixty-second embodiment can include the method of any one of the fifty-sixth to sixty-first embodiments, further comprising providing balance pressure through the balance line sufficient to overcome hydrostatic pressure of the control line.

A sixty-third embodiment can include the method of any one of the fifty-sixth to sixty-second embodiments, further comprising providing control pressure through the control line to open a valve of the WRSV.

A sixty-fourth embodiment can include the method of any one of the fifty-sixth to sixty-third embodiments, further comprising, upon loss of pressure in the control line, closing the valve of the WRSV.

A sixty-fifth embodiment can include the method of any one of the fifty-sixth to sixty-fourth embodiments, wherein control and balance pressure are supplied from the surface.

A sixty-sixth embodiment can include the method of any one of the fifty-sixth to sixty-fifth embodiments, wherein providing fluid communication between the control line and an operating piston of the WRSV through the TRSV comprises opening a first flowpath through the TRSV (e.g. providing fluid communication from the control line to the bore of the TRSV).

A sixty-seventh embodiment can include the method of any one of the fifty-sixth to sixty-sixth embodiments, wherein providing fluid communication between the balance line and a balance piston of the WRSV through the TRSV comprises opening a second flowpath through the TRSV (e.g. providing fluid communication from the balance line to the bore of the TRSV).

A sixty-eighth embodiment can include the method of any one of the fifty-sixth to sixty-seventh embodiments, wherein an exit for the first flowpath is axially offset from an exit for the second flowpath.

A sixty-ninth embodiment can include the method of any one of the fifty-sixth to sixty-eighth embodiments, wherein opening the first and second fluid flowpath comprises rupturing or shearing a plug (e.g. before seating the WRSV in the TRSV).

A seventieth embodiment can include the method of any one of the fifty-sixth to sixty-eighth embodiments, wherein opening the first and second fluid flowpath comprises, prior to seating the WRSV in the TRSV, cutting the (e.g. exits for)

first and second fluid flowpath in the interior surface of the TRSV (e.g. using a cutting tool).

A seventy-first embodiment can include the method of any one of the fifty-sixth to seventieth embodiments, wherein seating the WRSV in the bore of the TRSV holds open the valve in the TRSV (e.g. with the WRSV extending through the valve of the TRSV).

A seventy-second embodiment can include the method of any one of the fifty-sixth to seventy-first embodiments, wherein seating WRSV in bore of the TRSV provides sealing between the WRSV and the TRSV (e.g. providing a first sealed space between the TRSV and WRSV through which fluid communication between the control line and the WRSV through the TRSV occurs, and providing a second sealed space between the TRSV and WRSV through which fluid communication between the balance line and the WRSV through the TRSV occurs).

A seventy-third embodiment can include the method of any one of the fifty-sixth to seventy-second embodiments, wherein the first and second sealed spaces are axially offset.

A seventy-fourth embodiment can include the method of any one of the fifty-sixth to seventy-third embodiments, wherein the WRSV comprises any one of the first to forty-fifth embodiments.

A seventy-fifth embodiment can include the method of any one of the fifty-sixth to seventy-fourth embodiments, further comprising positioning the WRSV in the TRSV using a wireline.

A seventy-sixth embodiment can include the method of any one of the fifty-sixth to seventy-fifth embodiments, wherein the TRSV is disposed in a tubing string disposed downhole in the well.

A seventy-seventh embodiment can include the method of any one of the fifty-sixth to seventy-sixth embodiments, wherein the TRSV valve is malfunctioning (e.g. no longer operates effectively as a (e.g. hydraulic) safety valve).

In a seventy-eighth embodiment, a method of making a WRSV, comprising: placing an operating piston in fluid communication with a control port; placing a balance piston in fluid communication with a balance port; placing one or more wellbore pressure port in fluid communication with both the operating piston and the balance piston; and linking the operating piston and the balance piston to move axially together; wherein pressure from the control port on the operating piston is axially opposed to pressure from the balance port on the balance piston; pressure from the one or more wellbore pressure port on the operating piston is opposite pressure from the control port; and pressure from the one or more wellbore pressure port on the balance piston is opposite pressure from the balance port.

A seventy-ninth embodiment can include the method of the seventy-eighth embodiment, further comprising providing a body having a longitudinal bore therethrough; and disposing a valve in the bore, wherein pressure from the control port is operable to open the valve, and a loss of pressure through the control port is operable to close the valve.

An eightieth embodiment can include the method of any one of the seventy-eighth to seventy-ninth embodiments, further comprising providing a sliding sleeve in the bore, wherein the sliding sleeve has a closed position and an open position, in the open position the sleeve extends through the valve, wherein the sleeve is biased from the open position towards the closed position.

An eighty-first embodiment can include the method of any one of the seventy-eighth to eightieth embodiments, wherein the operating piston is configured to translate the sleeve from the closed position to the open position (e.g. responsive to application of sufficient pressure through the control port).

An eighty-second embodiment can include the method of any one of the seventy-eighth to eighty-first embodiments, further comprising providing three seals on an exterior of the body, each configured to seal between the body and a TRSV into which the WRSV is configured to seat.

An eighty-third embodiment can include the method of any one of the seventy-eighth to eighty-second embodiments, wherein the three seals are axially spaced.

An eighty-fourth embodiment can include the method of any one of the seventy-eighth to eighty-third embodiments, wherein the control port is disposed between the first and second seals, and the balance port is disposed between the second and third seals.

An eighty-fifth embodiment can include the method of any one of the seventy-eighth to eighty-fourth embodiments, wherein a first side of the operating piston has a first surface area, a second side of the operating piston has a second surface area, a first side of the balance piston head has a third surface area, a second side of the balance piston head has a fourth surface area, and a balance piston rod has a fifth surface area (e.g. on the axial end of the rod); and wherein the first surface area is approximately equal to the second surface area, the first surface area is approximately equal to the third surface area, the fourth surface area is approximately equal to the third surface area plus the fifth surface area, and the fourth surface area is approximately equal to the second surface area plus the fifth surface area.

An eighty-sixth embodiment can include the method of any one of the seventy-eighth to eighty-fifth embodiments, wherein the control port is in fluid communication with a first side of the operating piston (e.g. a first side of the head of the operating piston); the balance port is in fluid communication with a first side of the balance piston head; a second side of the operating piston (e.g. opposite the first side of the operating piston) and a second side of the balance piston head are configured to be in fluid communication with the one or more wellbore pressure port; the balance piston rod extends outward from the first side of the balance piston head; and the balance piston rod is configured to be in fluid communication with the one or more wellbore pressure port.

An eighty-seventh embodiment can include the method of any one of the seventy-eighth to eighty-sixth embodiments, wherein the WRSV comprises one of the first to forty-fifth embodiments.

An eighty-eight embodiment can include the method of any one of the forty-sixth to eighty-seventh embodiments, further comprising performing one or more downhole process/operation such as pumping fluid uphole and/or downhole in the tubular string and/or annulus.

An eighty-ninth embodiment, wherein initially downhole process/operation is performed using the TRSV in the tubular to provide hydraulic safety valve functionality, but upon failure of the TRSV, downhole process/operation is performed using the WRSV disposed in the TRSV to provide hydraulic safety valve functionality.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k* (Ru-RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A wireline retrievable safety valve for use in a tubing retrievable safety valve (TRSV) disposed downhole in a wellbore, comprising:

a body having a bore therethrough, a control port, and a balance port;

an operating piston;

a balance piston having a head and a rod; and a valve having an open position and a closed position;

wherein:

the control port is in fluid communication with a first side of the operating piston;

the balance port is in fluid communication with a first side of the balance piston head;

a second side of the operating piston and a second side of the balance piston head are configured to be in fluid communication with the wellbore through one or more wellbore pressure ports;

the balance piston rod extends outward from the first side of the balance piston head;

the balance piston rod is configured to be in fluid communication with the wellbore;

the operating piston and the balance piston are linked to move together; and the valve is configured so that sufficient pressure applied to the operating piston through the control port opens the valve.

2. The safety valve of claim 1, wherein the first side of the operating piston is axially opposed to the first side of the balance piston head.

3. The safety valve of claim 2, wherein the first side of the operating piston has a first surface area, the second side of the operating piston has a second surface area, the first side of the balance piston head has a third surface area, the second side of the balance piston head has a fourth surface area, and the balance piston rod has a fifth surface area; and wherein the first surface area is approximately equal to the second surface area, the first surface area is approximately equal to the third surface area, the fourth surface area is approximately equal to the third surface area plus the fifth surface area, and the fourth surface area is approximately equal to the second surface area plus the fifth surface area.

4. The safety valve of claim 3, wherein the operating piston comprises a head and a rod, the rod extends outward from the second side of the operating piston head opposite the first side of the operating piston, and the second side of the operating piston comprises both the second side of the operating piston head and the operating piston rod.

5. The safety valve of claim 1, wherein the operating piston and the balance piston are linked by a connecting ring.

6. The safety valve of claim 1, wherein:

the body is configured to be disposed in a bore of a tubing retrievable safety valve, wherein the tubing retrievable safety valve is in fluid communication with a control line and a balance line;

the body is configured to place the control port in fluid communication with the control line through the TRSV and the balance port in fluid communication with the balance line through the TRSV; and the body is configured to lock a valve of the TRSV open.

7. The safety valve of claim 1, wherein the balance port and the control port are axially spaced apart.

8. The safety valve of claim 1, further comprising three seals, wherein the three seals are configured to form two sealed spaces between the body and the TRSV, wherein the control port is disposed in a first sealed space and the balance port is disposed in a second sealed space.

9. The safety valve of claim 1, further comprising:

a sliding sleeve disposed within the body, having a first position and a second position, wherein in the first position the valve is closed and in the second position the sleeve extends through the valve to hold the valve open; and a spring configured to bias the sleeve from the second position towards the first position;

wherein the spring does not have to overcome hydrostatic pressure of the control line to close the valve.

10. A safety valve for use in a wellbore, comprising:

a body having a bore therethrough, a control port, and a balance port;

an operating piston in fluid communication with the control port;

a balance piston in fluid communication with the balance port; and a valve having an open position and a closed position;

wherein:

the operating piston and the balance piston are linked to move axially together;

pressure from the control port on the operating piston is axially opposed to pressure from the balance port on the balance piston, such that pressure on one acts downhole, while pressure on an other acts uphole;

the valve is configured so that sufficient pressure applied to the operating piston through the control port opens the valve; and the body is configured to seat within a TRSV and thereby to hold open a valve of the TRSV.

11. The safety valve of claim 10, wherein wellbore pressure is applied to each of the operating piston and the balance piston; and wherein the wellbore pressure on the operating piston is axially opposed to the wellbore pressure on the balance piston such that wellbore pressure on one acts uphole while wellbore pressure on the other acts downhole.

12. The safety valve of claim 11, wherein wellbore pressure is applied to the operating piston opposite the pressure from the control port, and wellbore pressure is applied to the balance piston opposite the pressure from the balance port.

13. A system for use downhole in a wellbore, comprising:

a tubular string having a TRSV disposed therein;

the wireline retrievable safety valve (WRSV) of claim 1 disposed in a bore of the TRSV;

a control line providing control pressure from the surface to the TRSV;

a balance line providing balance pressure from the surface to the TRSV;

wherein:

the WRSV holds a flapper valve of the TRSV open;

a control port of the WRSV is in fluid communication with the control line through the TRSV;

a balance port of the WRSV is in fluid communication with the balance line through the TRSV; and pressure applied through the control line is operable to open a valve of the WRSV.

14. The system of claim 13, wherein the first side of the operating piston is axially opposed to the first side of the balance piston head, such that pressure on the first side of the operating piston acts downhole, while pressure on the first side of the balance piston head acts uphole.

15. The system of claim 13, wherein the TRSV comprises a TRSV operating piston in fluid communication with the control line.

16. The system of claim 13, wherein prior to disposing the WRSV in the bore of the TRSV, the TRSV flapper valve is no longer functional.

17. A method of providing hydraulic safety valve functionality in a wellbore, comprising:

seating the WRSV of claim 1 in a bore of a TRSV disposed in the wellbore, wherein a control line provides control pressure to the TRSV and a balance line provides balance pressure to the TRSV;

providing fluid communication between the control line and an operating piston of the WRSV through the TRSV; and providing fluid communication between the balance line and a balance piston of the WRSV through the TRSV;

wherein seating the WRSV in the bore of the TRSV holds open a valve of the TRSV.

18. The method of claim 17, wherein the operating piston and the balance piston of the WRSV are linked to move together; and pressure from the control line on the operating piston is axially opposed to pressure from the balance line on the balance piston;

the method further comprising providing wellbore pressure to each of the operating piston and the balance piston, with the wellbore pressure on the operating piston axially opposed to the wellbore pressure on the balance piston.

19. The method of claim 18, wherein wellbore pressure provided to the operating piston is opposite pressure from the control line, and wellbore pressure provided to the balance piston is opposite pressure from the balance line.

20. The method of claim 17, further comprising providing balance pressure through the balance line sufficient to overcome hydrostatic pressure of the control line.

21. The method of claim 20, further comprising providing control pressure through the control line to open a valve of the WRSV.

22. The method of claim 17, wherein providing fluid communication between the control line and an operating piston of the WRSV through the TRSV comprises opening a first flowpath through the TRSV; and providing fluid communication between the balance line and a balance piston of the WRSV through the TRSV comprises opening a second flowpath through the TRSV.

23. The method of claim 22, wherein seating the WRSV in the bore of the TRSV provides sealing between the WRSV and the TRSV, forming a first sealed space between the TRSV and the WRSV and a second sealed space between the TRSV and the WRSV; wherein the first and second sealed spaces are axially offset; wherein the first flowpath is in fluid communication with the first sealed space, and the second fluid flowpath is in fluid communication with the second sealed space; and wherein the operating piston is in fluid communication with the first sealed space, and the balance piston is in fluid communication with the second sealed space.

* * * * *